US011135479B2

(12) United States Patent
Hall

(10) Patent No.: US 11,135,479 B2
(45) Date of Patent: Oct. 5, 2021

(54) ANCHORS FOR CLIMBING AND RELATED ACTIVITIES

(71) Applicant: Matthew Hall, Whakatane (NZ)

(72) Inventor: Matthew Hall, Whakatane (NZ)

( * ) Notice: Subject to any disclaimer, the term of this patent is extended or adjusted under 35 U.S.C. 154(b) by 17 days.

(21) Appl. No.: 16/498,669

(22) PCT Filed: Mar. 28, 2018

(86) PCT No.: PCT/NZ2018/050038
§ 371 (c)(1),
(2) Date: Sep. 27, 2019

(87) PCT Pub. No.: WO2018/182431
PCT Pub. Date: Oct. 4, 2018

(65) Prior Publication Data

US 2020/0038710 A1 Feb. 6, 2020

(30) Foreign Application Priority Data

Mar. 28, 2017 (NZ) ..... 730516
May 22, 2017 (NZ) ..... 732148

(51) Int. Cl.
*A63B 29/02* (2006.01)

(52) U.S. Cl.
CPC ..... *A63B 29/024* (2013.01)

(58) Field of Classification Search
CPC ..... A63B 29/024; A63B 29/02
USPC ..... 248/231.9, 317
See application file for complete search history.

(56) References Cited

U.S. PATENT DOCUMENTS 3,877,679 A * 4/1975 Lowe ..... A63B 29/024 248/694
3,948,485 A * 4/1976 Chouinard ..... A63B 29/024 248/694
3,957,237 A * 5/1976 Campbell ..... A63B 29/024 248/694
4,044,976 A * 8/1977 Campbell ..... A63B 29/024 248/694
4,422,607 A * 12/1983 Vallance ..... A63B 29/024 248/694

(Continued)

FOREIGN PATENT DOCUMENTS

EP 1854511 A1 11/2007
EP 2353664 A1 8/2011
WO 20160192811 A1 12/2016

*Primary Examiner* — Muhammad Ijaz
(74) *Attorney, Agent, or Firm* — Larson & Anderson, LLC

(57) ABSTRACT

Disclosed is an anchor for rock or similar material, and methods therefor. The anchor has a hinged base, which base consists of at least a pair of pivotally connected wings, the wings able to pivot about at least one longitudinal axis between, a first position in a closed state and a second position in an open state, the open state having a dimension between opposing parts of each wing that is greater than when in the closed state. A locking mechanism locks the wings in either the first position, or the second position. A connecting portion adapted to enable a load to be connected to the anchor connects to the hinged base, the connecting portion having a loading axis which is substantially parallel to the longitudinal axis. The anchor can be set between either the first position, or the second position, and then anchored to enable a load to be connected thereto.

48 Claims, 22 Drawing Sheets

(56) References Cited

U.S. PATENT DOCUMENTS 4,565,342 A * 1/1986 Grow ..... A63B 29/024 248/231.9
4,575,032 A 3/1986 Taylor
4,643,377 A * 2/1987 Christianson ..... A63B 29/024 248/231.9
4,832,289 A 5/1989 Waggoner
5,794,914 A * 8/1998 Woodward ..... A63B 29/024 248/317
6,070,842 A * 6/2000 Sandahi ..... A63B 29/024 248/231.9
6,119,993 A * 9/2000 Youngblood ..... A63B 29/024 248/231.9
6,273,379 B1 * 8/2001 Phillips ..... A63B 29/024 248/231.9
6,283,426 B1 * 9/2001 Guthrie ..... A63B 29/024 248/231.21
7,140,583 B2 11/2006 Petzl
7,802,770 B2 9/2010 Field, Jr.
7,959,119 B2 * 6/2011 Tusting ..... A63B 29/024 248/231.9
10,143,892 B2 * 12/2018 Baker ..... F16B 2/18
2002/0098054 A1 * 7/2002 Guthrie ..... F16B 13/0891 411/60.1
2002/0162927 A1 11/2002 Brown
2005/0145765 A1 * 7/2005 Petzl ..... A63B 29/024 248/231.9
2005/0145766 A1 * 7/2005 Petzl ..... A63B 29/024 248/231.91
2006/0231708 A1 * 10/2006 Robertson ..... A63B 29/024 248/231.9
2007/0194193 A1 * 8/2007 Klingler ..... A63B 29/024 248/231.9
2009/0134294 A1 * 5/2009 Hemsley ..... A63B 29/024 248/231.9
2009/0230268 A1 * 9/2009 Maltsev ..... A63B 29/02 248/231.9
2010/0263478 A1 * 10/2010 Reed ..... A63B 29/024 74/567
2014/0117187 A1 * 5/2014 Crellin ..... A63B 29/024 248/317
2015/0001360 A1 * 1/2015 Czech ..... A63B 29/024 248/231.9
2018/0001175 A1 * 1/2018 Davidson ..... A63B 69/0048
2020/0038710 A1 * 2/2020 Hall ..... A63B 29/024
2021/0001181 A1 * 1/2021 Steck ..... A63B 29/024

* cited by examiner

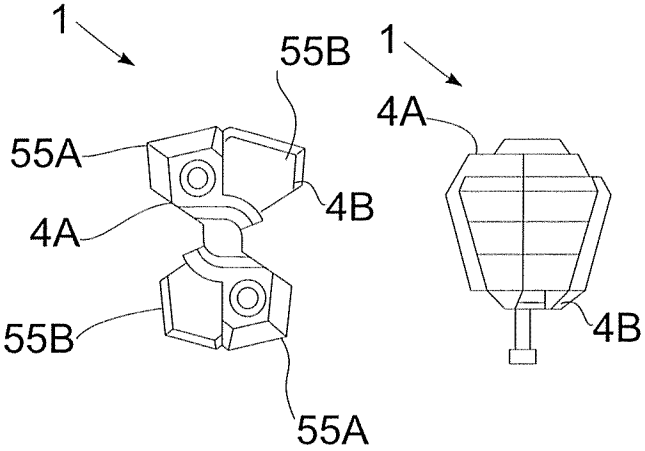
Figure 33A
Figure 33B
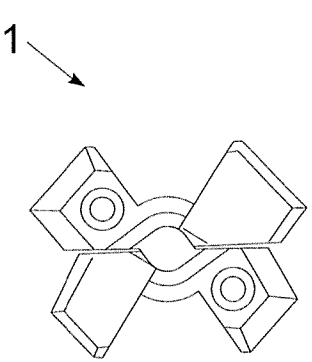
Figure 33C
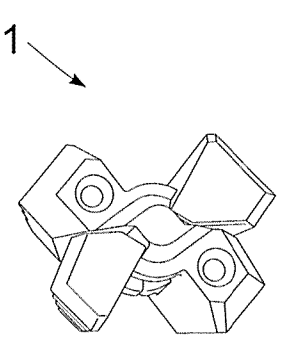
Figure 33D
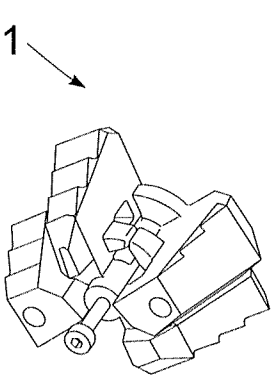
Figure 33E

ANCHORS FOR CLIMBING AND RELATED ACTIVITIES

TECHNICAL FIELD OF THE INVENTION

The present invention relates to improvements in, or relating to, anchors for climbing and related activities.

In particular, though not solely, the present invention is directed to anchors for climbing, abseiling and similar vertical, or near vertical activities, where the anchor has variable geometry. Such variable geometry may be static, in that it is pre-set prior to anchoring in the anchoring surface, for example rock, or may be dynamic, in that it adapts to the anchoring surface as it is located in place, or moves or similar.

BACKGROUND OF THE INVENTION

There is a need to provide an anchor in an anchoring surface, for example when access to a vertical or near vertical region is needed or desired. Typically a rope is connected from the anchor either directly or indirectly. A user can then access the area desired via the rope, or my use the rope to haul a piece of equipment up or down, or the anchor may be used to hold something in place.

Such a need may be for leisure, such as rock climbing and similar activities, or may be for maintenance or work, such as for access on a worksite of similar.

The sport of rock climbing has grown over time. This growth has been both in the numbers of people climbing, and the type of terrain climbed. Initially rock climbing involved what became known as aid climbing. This involved a person gaining purchase on, for example, a rock face using equipment like picks, hooks and similar, and pulling them selves up the rock face. The user would place protection periodically which connected to a rope which connected to them to catch them if they fell.

This method then evolved into what became known as freeclimbing or sport climbing. This involved the user only using their body, mainly their feet and hands, arms, to scale the vertical, or near vertical face, including overhands and similar. The climber wears shoes with soft rubber soles to help them grip the rock, and takes advantage of the natural contours of the rock to enable them to scale it. The climber ascends in a style referred to as leading. This involved placing protection as the climber advanced up the face. The protection would be passive or static. Static protection may for example be those referred to as pre-shaped blocks, variously called wires, hexes or blocks, that when fitted into any convenient cracks or crevices thereby create a mechanical anchor point. These rely on their carefully created shape to become a wedge in a rock crack or similar formation which would resist being pulled out. More often the protection is formed so that it one piece can fit in a variety of sized cracks, and comes in a range of sizes.

Another form of protection is dynamic, in contrast to the passive protection described above. This relies on multiple cams with an increasing diameter profile, such as those known as Friendsù, Cannalotsù, and FlexCamsù, otherwise referred to as Spring Loaded Caroming Devices (SLCDs). The cams can be 'retracted_to make the appearance of the protection narrow so as to fit into a slot or crack, and then when released, expand initially under spring action to lock in place in the rock or similar. When placed under load the cams are forced to become wider and so therefore hold more strongly in the crack or slot.

These types of protection may be used for lead climbing as described, or as anchors for top roping, or abseiling.

One of the shortcomings of these types of protection, both static and dynamic, is that each can only cover a range of sizes. Therefore a climber must carry more equipment and therefore more weight.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved anchor for climbing and related activities, or to at least provide an anchor that covers a wider range, or to overcome the above shortcomings or address the above desiderata, or to at least provide the public with a useful choice.

BRIEF DESCRIPTION OF THE INVENTION

In a first aspect the present invention consists in an anchor for rock or similar material, comprising or including, A hinged base, which base consists of at least a pair of pivotally connected wings, the wings able to pivot about at least one longitudinal axis between, a first position in a closed state and a second position in an open state, the open state having a dimension between opposing parts of each wing that is greater than when in the closed state, A locking mechanism to lock the wings in either the first position, or the second position, A connecting portion connected to the hinged base and adapted to enable a load to be connected to the anchor, the connecting portion having a loading axis which is substantially parallel to the longitudinal axis, Wherein the anchor can be set between either the first position, or the second position, and then anchored into the rock or similar material to enable a load to be connected thereto.

Preferably the locking mechanism can lock the wings in any position between the first position and the second position.

Preferably the anchor may be located in a crack or similar in the rock or similar material and then set from the first position to the second position prior to anchoring.

Preferably the anchor can be placed in the rock or similar material by a user only using one hand.

Preferably the locking mechanism can be de-activated to allow movement from the first position to the second position, by one hand only of a user.

Preferably the movement from the first position to the second position, when the locking mechanism is de-activated, consists of a relative rotation of the first wing to the second wing about the longitudinal axis, and then a relative sliding between the two wings along the longitudinal axis.

Preferably a first wing of the wing pair has a shaft extending therefrom, and a second wing of the pair had a complimentary bore to receive the shaft to provide a pivot there between to allow the movement about and along the longitudinal axis.

Preferably the first and second wings of the pair both have a bore therein to mount on, and rotate about a separate shaft.

Preferably the shaft and bore act as a guide for the relative rotation about the longitudinal axis, and the relative sliding of the two wings along longitudinal axis.

Preferably the locking mechanism includes co-operating portions, either with one on each of the first and second wings, or one co-operating portion (ie upper radial example) attached entirely to one wing, acting on the flat face of the other wing. The co-operating portions locking the wings in the first position when the locking mechanism is activated.

Preferably de-activation of the locking mechanism at least disengages the co-operating portions to allow the wings to move from the first position to the second position, and vice versa.

Preferably de-activation of the locking mechanism is achieved by a locking portion disengaging with the first wing, or second wing, to then allow the relative rotation and then relative sliding.

Preferably there is a locking handle, at or toward an end of the connecting portion distal from the hinged base, that acts on the locking portion, to allow de-activation and activation of the locking mechanism.

Preferably the locking handle takes the form of a pull loop, ring or similar.

Preferably the locking handle and locking portion move parallel to the longitudinal axis.

Preferably the locking handle has at least a tensile connection to the locking portion.

Preferably the co-operating portions on each wing can engage each other, after the relative rotation of each of the wings, by the relative sliding to lock the wings in the second position.

Preferably the co-operating portions on each wing can dis-engage each other, after the relative sliding to un-lock the wings from the second position, then relative rotation of each of the wings to the first position.

Preferably the two wings are biased to move from the first position to the second position when the locking mechanism is de-activated.

Preferably the biasing is by a primary biasing means for rotation, and a secondary biasing means for the relative sliding.

Preferably the primary biasing means is a torsion spring mounted about the longitudinal axis to cause the relative rotation.

Preferably the secondary biasing means is a linear spring acting parallel to the longitudinal axis to cause the relative sliding of the first wing and the second wing to then engage the co-operating portions.

Preferably the co-operating portions consist of at least one extension from the first wing orthogonal to the longitudinal axis, which at least one extension can be received into a complimentary recess in the second wing when in the first position.

Preferably there are two extensions, one from each of the first wing and the second wing that are received into complimentary recess, one each on the first wing and the second wing, when in the first position.

Preferably the at least two extensions engage each other on their facing surfaces when in the second position.

Preferably the wings, at least when in the first position, together form a trapezoidal shape when seen from the sides.

Preferably the wings taper inwards to form the trapezoidal shape from an end distal from the connecting portion.

Preferably the wings, when in the second position form an 'X_configuration when seen along the longitudinal axis.

Preferably there is a base cover at the distal end, the base cover being engaged to the second wing.

Preferably the base cover is engaged to second wing at least by protrusions from the base cover into complimentary recesses in the second wing, or vice versa.

Preferably the torsion spring is located between the base cover and the first wing, such that the first wing rotates relative to the base cover when the locking mechanism is de-activated.

Preferably the locking portion is slidingly engaged with the second wing via retaining pins, and slidingly engaged with the first wing via teeth that are shorter than the retaining pins.

Preferably the locking portion when slid along the longitudinal axis, away from the first wing and the second wing, disengages the teeth from the first wing to allow it to then rotate, but remains engaged with the second wing via the retaining pins.

Preferably the secondary biasing means also acts against the locking portion and thus the locking handle.

Preferably the connecting portion is at least in part flexible.

Preferably the connecting portion is a single length of wire rope, or similar, that runs from the base portion to an end distal to the base portion which then terminates in a loop or similar to allow connection of the load.

Preferably the connecting portion is a loop of wire rope, or similar, that runs from the base portion, through one arm of a first wing, to an end distal to the base portion, and back again through a second arm of the first wing, so forming a loop or similar to allow connection of the load distal from the base portion.

Preferably the connecting portion is a loop whose ends terminate on each wing in a swaged or brazed connection.

Preferably there are apertures through the first wing, or the second wing and base portion, or both, which the connection portion can pass through and be connected to.

Preferably there are more than two wings.

An anchor as claimed in any one of claims 1 to 40 wherein there is a pivot for each wing all pivots parallel to the longitudinal axis.

Preferably there is one pivot per wing.

Preferably where there are multiple pivots there is at least part of the locking mechanism for each pivot.

Preferably there are some pivots that are not parallel to the longitudinal axis.

Preferably the locking mechanism involves a movable bar located on the base portion, which engages with complimentary features on a wing to allow pivoting when disengaged, and prevent pivoting when engaged.

Preferably the locking mechanism is one way that allows opening without de-activation of the locking system, but prevents closing without de-activation of the locking mechanism.

Preferably the one-way mechanism is a ratchet system, whereby the wing complimentary features and movable bar forms the one-way mechanism.

Preferably the locking mechanism is a sleeve that locates at least in part about the pivot axis, the sleeve having external engaging portions on its outer peripheral surface, and internal engaging portions on its inner peripheral surface, the sleeve locating in the base portion such that the external engaging portions engage with complimentary portions in the base portion, and the internal engaging portions engage with its respective wing when in a first locking position, the sleeve adapted to slide along its respective pivot axis to a second locking position, such that one, either or both, the external engaging portions, and the internal engaging portions are free of the base portion or respective wing, such that in the second position the wing is then allowed to pivot about the pivot axis.

Preferably the locking mechanism, whether a movable bar, or sleeve is moved to engage or disengage, or from the first position to the second position by a locking handle.

Preferably the locking mechanism allows movement of the wings one way, but not the other.

Preferably each wing consists of two lobes, each either side of the longitudinal axis.

Preferably the centre of the crossing of the two wings is on the longitudinal axis.

Preferably the wings and their lobes are of substantially the same size.

Preferably the lobes of one wing are smaller than the lobes of the other wing.

Preferably each wing has lobes of a first size and lobes of a second size which is of difference size to the first size.

Preferably the anchor has additional contouring on it to help engagement and retention with the rock or similar material.

Preferably the contouring is on the lobes.

Preferably the contouring takes the form of reliefs, protrusions or similar.

In another aspect the present invention consist in a method of providing an anchor for rock or similar material, comprising or including, the steps of, Pivotally connecting a pair of wings about at least one longitudinal axis and allowing the pair of wings to move pivotally relative to each other between a first position in an open state and a second position in a closed state, where the open state has a dimension between opposing parts of each wing pair that is greater than when in the closed state, Locking the pair of wings in either the first position or the second position, Providing a connecting portion connected to the pair of wings which is adapted to connect to a load, the connecting portion having a loading axis which is substantially parallel to the longitudinal axis, Wherein the method allows for the anchor to be set between either the first position, or the second position, and then anchored into the rock or similar material to enable a load to be connected thereto.

In another aspect the present invention consists in an anchor as described herein with reference to any one or more of the accompanying drawings.

In another aspect the present invention consists in a method of using an anchor as described herein with reference to any one or more of the accompanying drawings.

As used herein the term 'and/or_means 'and_or 'or_, or both.

As used herein '(s)_following a noun means the plural and/or singular forms of the noun.

The term 'comprising_as used in this specification means 'consisting at least in part of_. When interpreting statements in this specification which include that term, the features, prefaced by that term in each statement, all need to be present, but other features can also be present. Related terms such as 'comprise_and 'comprised_are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

The entire disclosures of all applications, patents and publications, cited above and below, if any, are hereby incorporated by reference.

This invention may also be said broadly to consist in the parts, elements and features referred to or indicated in the specification of the application, individually or collectively, and any or all combinations of any two or more of said parts, elements and features, and where specific integers are mentioned herein which have known equivalents in the art to which this invention relates, such known equivalents are deemed to be incorporated herein as if individually set forth.

Other aspects of the invention may become apparent from the following description which is given by way of example only and with reference to the accompanying drawings.

BRIEF DESCRIPTION OF THE DRAWINGS

Preferred forms of the present invention will now be described with reference to the accompanying drawings in which;

FIG. 33 shows the variation of FIGS. 26 to 31, with wings each having a lobe of one size, and each wing having a lobe of a second differing size, and additional contouring, and shows at (A) the anchor in the closed state from below, (B) side view in closed state, (C) plan view in open state, (D) top isometric view in open state, and (E) a side isometric view in open state.

DETAILED DESCRIPTION OF THE INVENTION

Figure 1:
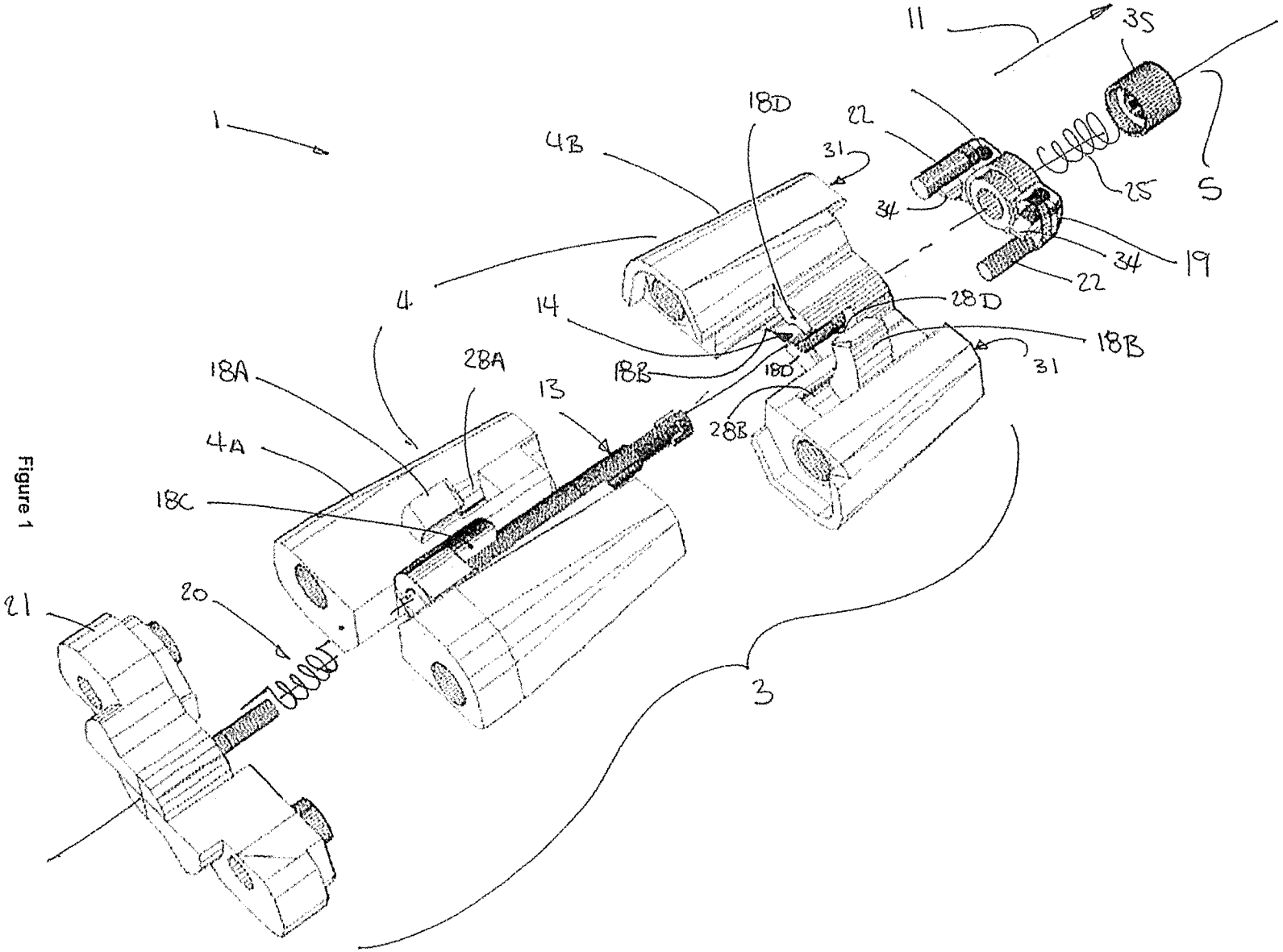
FIG. 1 Shows an exploded view of the anchor in one form of the present invention, FIG. 2 Shows an isometric top view of the anchor, FIG. 3 Shows a top view of the anchor, FIG. 4 Shows a bottom view of the anchor, FIG. 5 Shows a left side view, FIG. 6 Shows a right side view, FIG. 7 Shows a front view, FIG. 8 Shows a rearview, FIG. 9 Shows at (A), (B) and (C) a front, isometric top and isometric bottom views respectively of the anchor in the closed position, FIG. 10 Shows at (A), (B) and (C) a front, isometric top and isometric top close up views respectively of the anchor as the locking mechanism is retracted, FIG. 11 Shows at (A), and (B) isometric top and isometric bottom views respectively of the anchor unlocked and the wings rotated about the longitudinal axis towards the open position, FIG. 12 Shows at (A), and (B) isometric top and isometric bottom views respectively of the anchor unlocked and the wings rotated about the longitudinal axis to the open position, and the wings sliding along the longitudinal axis to the locked position, and engaging the locking mechanism of the co-operating portions, FIG. 13 Shows at (A), and (B) isometric top and isometric bottom close up views respectively of the anchor in the open position, showing the co-operating portions locking, FIG. 14 Shows in isometric the two possible locations of the connecting portion, through the longitudinal axis itself, as a single length of wire rope, or alternatively as a loop of wire rope or similar, for example through one or more of the wings, FIG. 15 Shows the anchor, located in a crack in the rock, FIG. 16 Shows an end view of a further variation of anchor with two wings that pivot about two parallel Z axes to again vary the size of the anchor in the X-Y plane, in series for left to right (A) folded to smallest size, (B) partially open, (C) further open, (D) further open again, and (E) open to lie as wide as possible, FIG. 17 Shows an end view of a further variation of anchor with four wings that pivot about four parallel Z axes to again vary the size of the anchor in the X-Y plane, again from fully closed to fully open and the stages in between, FIG. 18 Shows a variation of the anchor shown in FIG. 16, in isometric view at (A) with the wings compacted, and at (B) with the wings partially open, FIG. 19 Shows a wing shape variation to suit different anchor material formations or uses, FIG. 20 Shows a close up of the variation in FIGS. 18(A) and (B) showing one form of the locking mechanism, locked at (A) and unlocked at (B), FIG. 21 Shows a close up of another form of the locking mechanism, using a collar and pin to actuate the collar in isometric at (A), the mating 'gears_on the stem at (B) and the casing of the main body to receive the collar (C), the gears on the stem, shaft or pivot locate inside the collar, FIG. 22 Shows in isometric the method of disengagement of the locking mechanism, as a cutaway view of the bar and ratchet locking system shown in FIG. 20, FIG. 23 Shows in close up the engagement of the locking mechanism of FIG. 21(A)-(C), at (A) a close up, and (B) a further closeup of the collar, gears and casing teeth, FIG. 24 Shows a further movement in the series of the collar, gears and teeth of FIG. 23, FIG. 25 Show the general arrangement of the locking mechanism of FIGS. 21, 23 & 24, FIG. 26 Shows a further embodiment of the present invention closed state in front view with no externally activated locking mechanism, no torsion spring, and no end or locking cap (21) on one wing.

Preferred embodiments will now be described with reference to FIGS. 1 through 15. The anchor 1, is shown engaged in a crack in rock 2 or similar material in FIG. 15. The load 11 is shown acting downwards, and may be, for example from a climber attached to a rope 32, run through a carabiner 33 which in turn is attached, directly or indirectly, to the connecting portion 10. To clarify the following description the anchor is located in the crack with its top pointing down.

The anchor generally speaking can take a load in the Z axis, while allowing the user to vary the cross-sectional size of the anchor in the X-Y plane, orthogonal to the Z axis, by moving portions or wings of the anchor about one or more pivot axes parallel to the Z axis.

Figure 3:
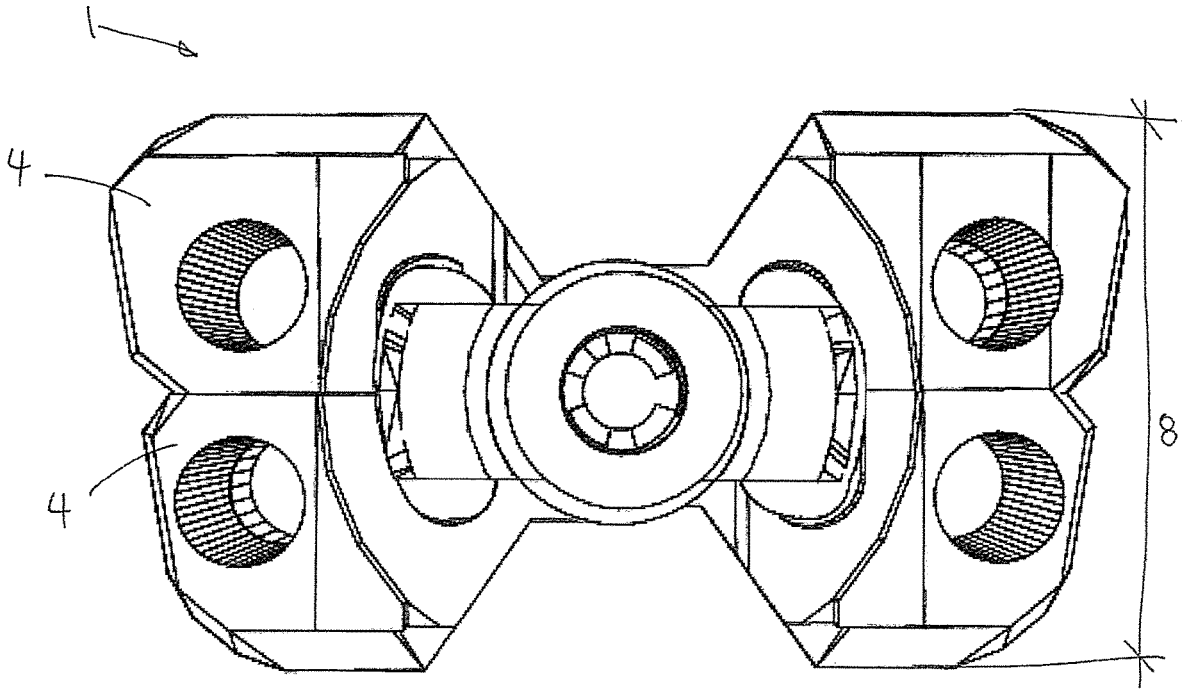
Figure 4:
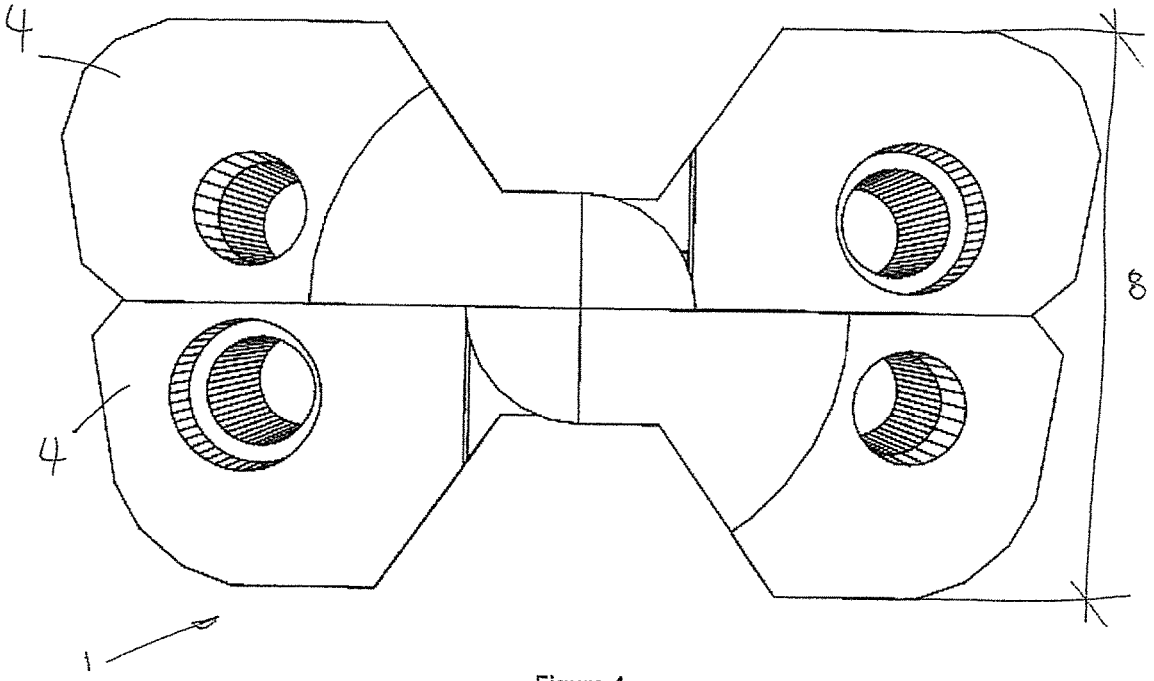
Figure 5:
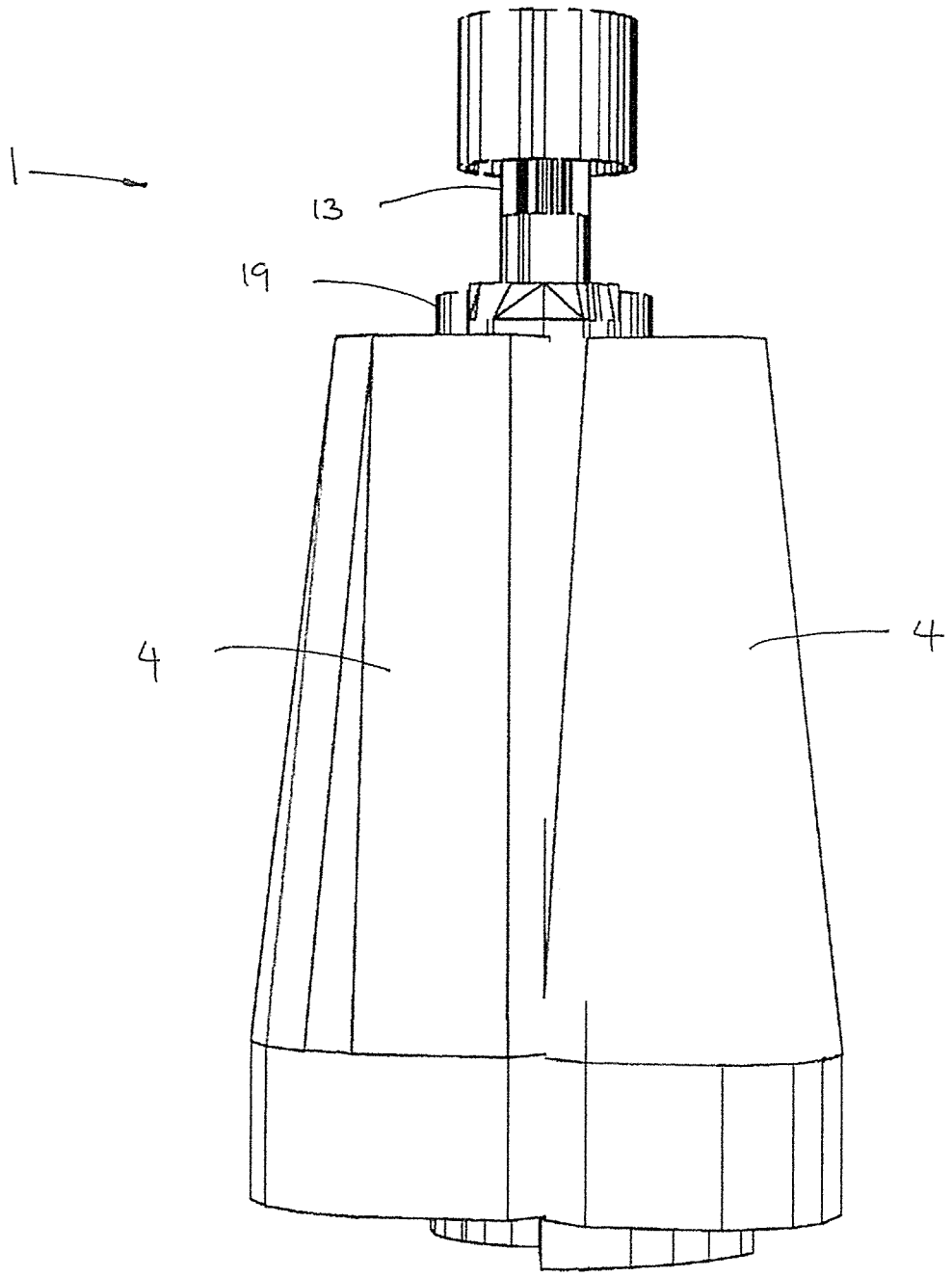
Figure 6:
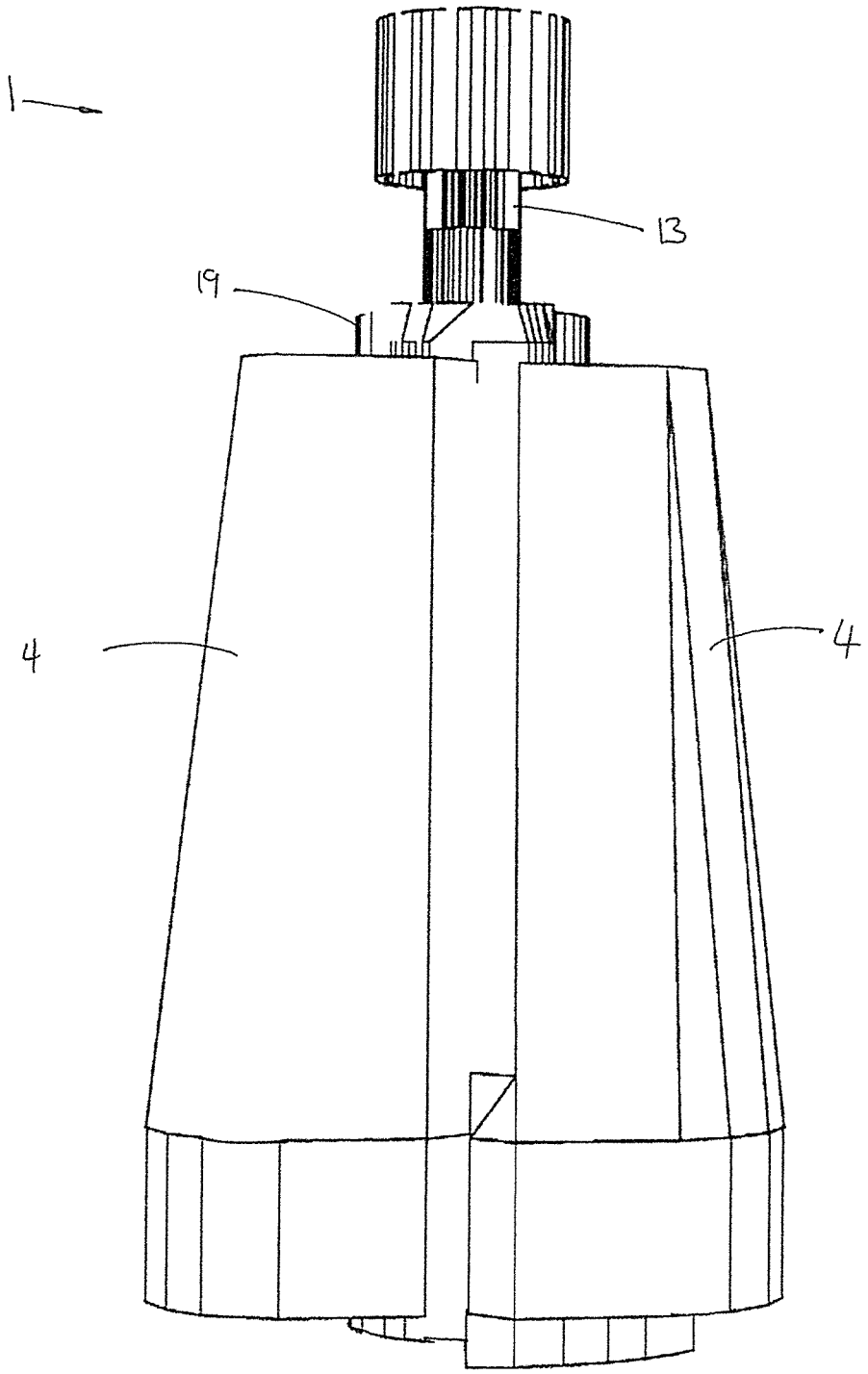
Figure 7:
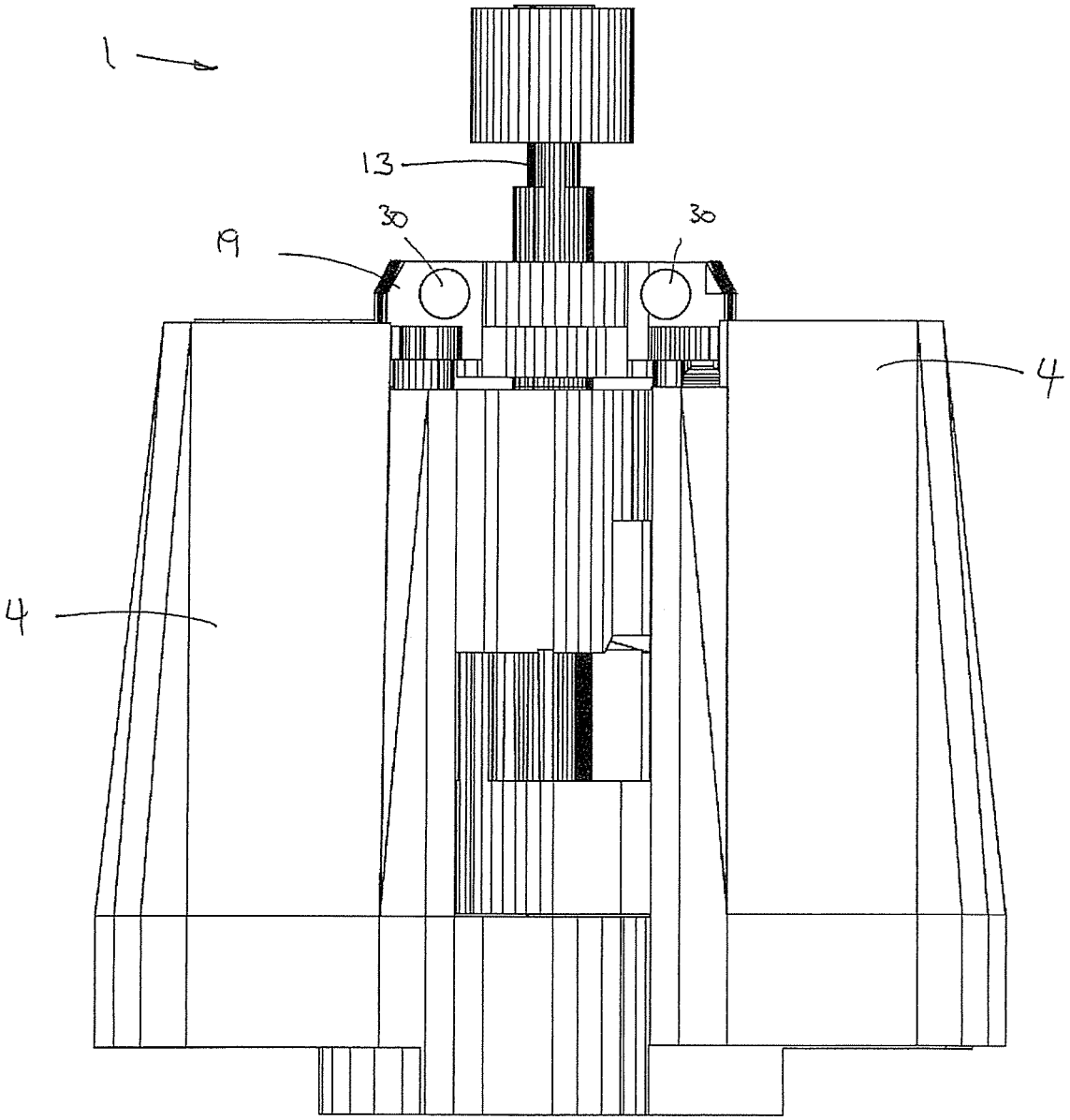
Figure 8:
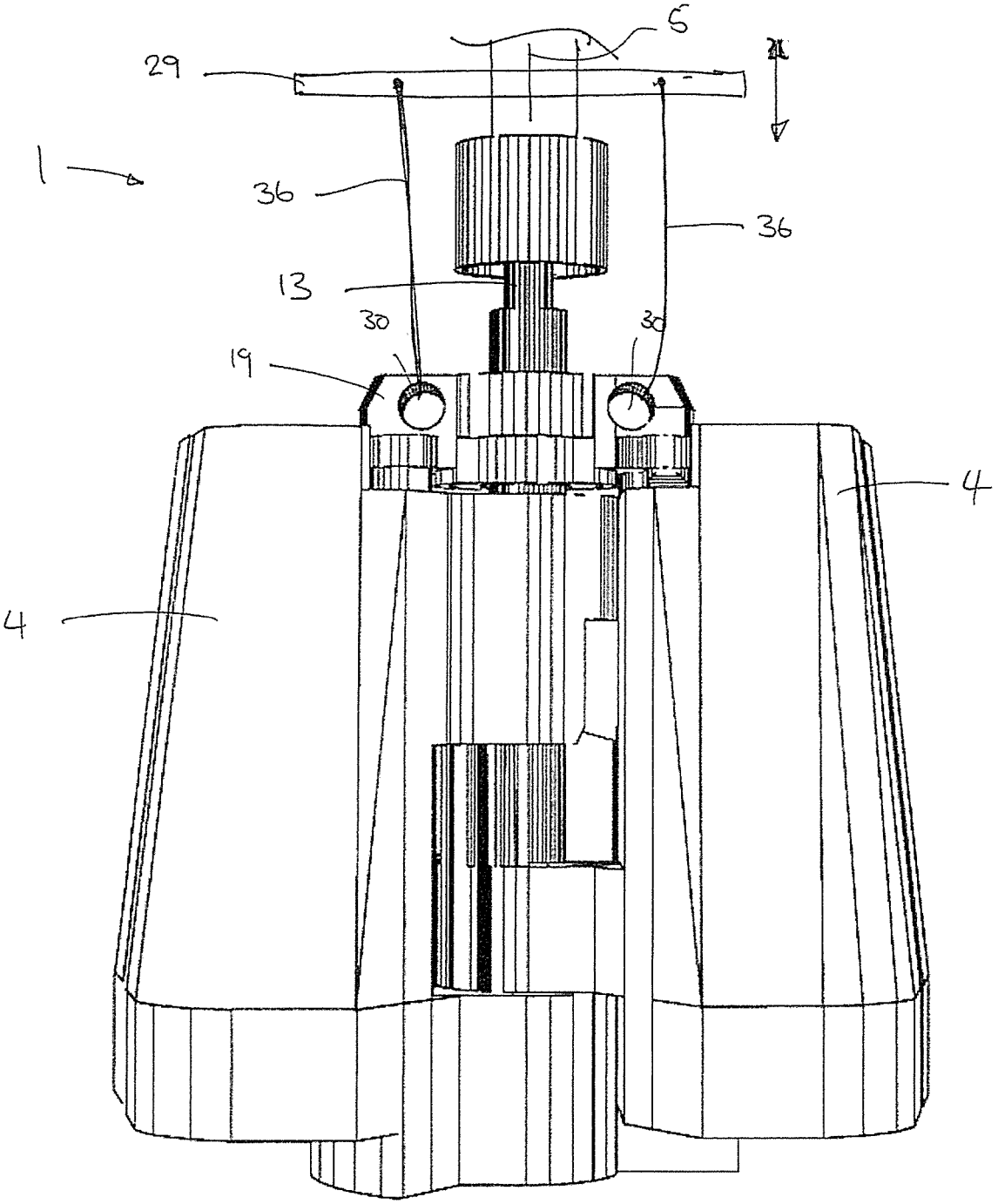
Figure 9A:
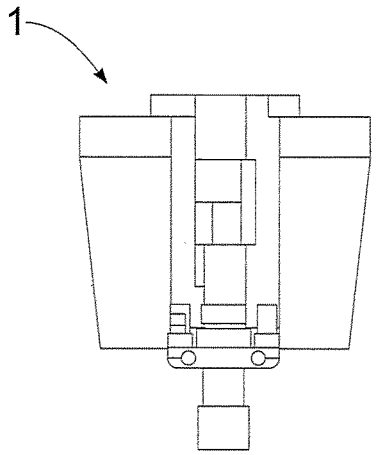
Figure 9B:
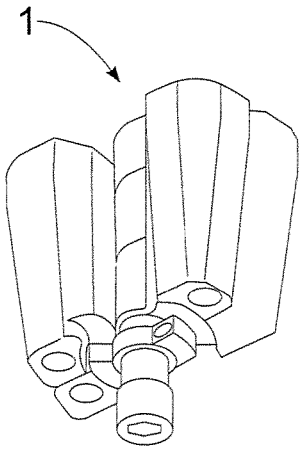
Figure 9C:
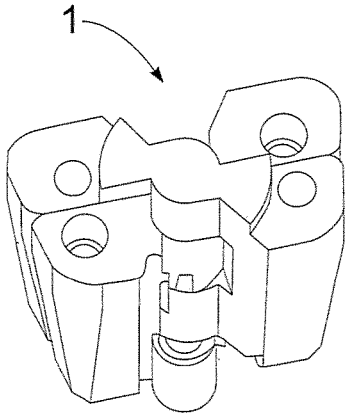
Figure 15:
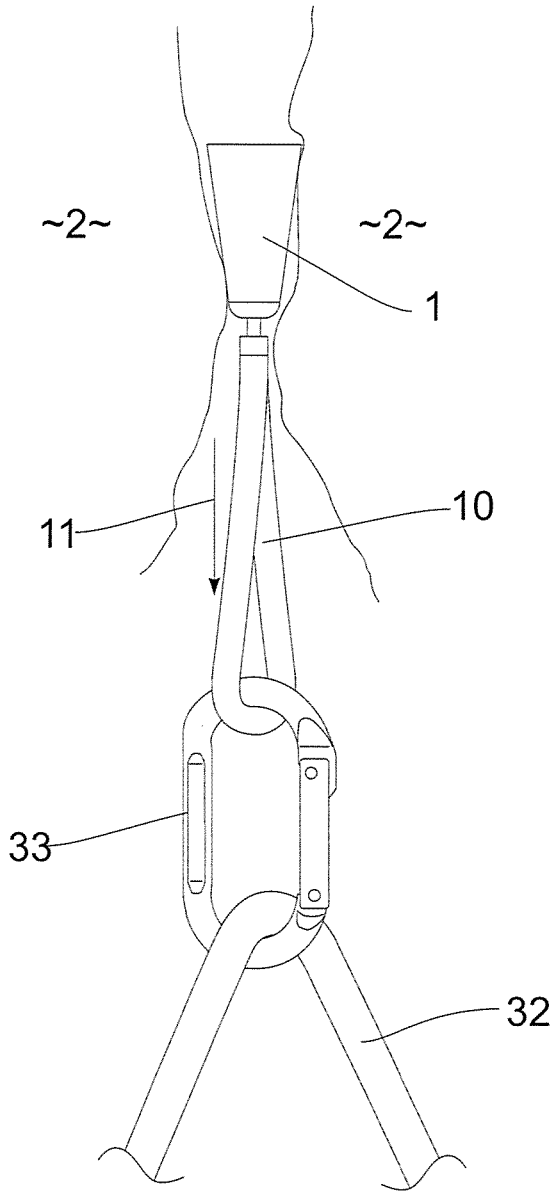

As shown in the embodiment in FIGS. 2 through 8, the anchor 1 has a trapezoidal shape when viewed from the sides. This shape tapers from the base portion 21 of the wings 4 to become narrower towards the top of the wings 4 as shown. This shape has the natural advantage of engaging with the rock 2, or similar, and wedging itself in place where the rock, or similar, narrows, as seen in FIG. 15. The wings 4, as shown when in the closed state 6 present a different size of trapezoid when seen from the side as in FIGS. 5 and 6, compared to the back or front as seen in FIGS. 7 and 8. This conveys the natural advantage of providing at least two sizes of hinged base 3 in the one anchor 1. In other forms of the present invention the trapezoidal shape may vary on each of the 4 sides to convey more sizes of hinged base 3. Alternatively the side shape formed, for example a trapezoid, may be the same from all sides. The hinged base 3, and therefore at least in part the wings 4, may be further sculpted as needed to provide better purchase in the rock 2. For example there may be added concavities or convexities, the side profiles may be curved or have other forms as desired to provide a better anchor.

Figure 14:
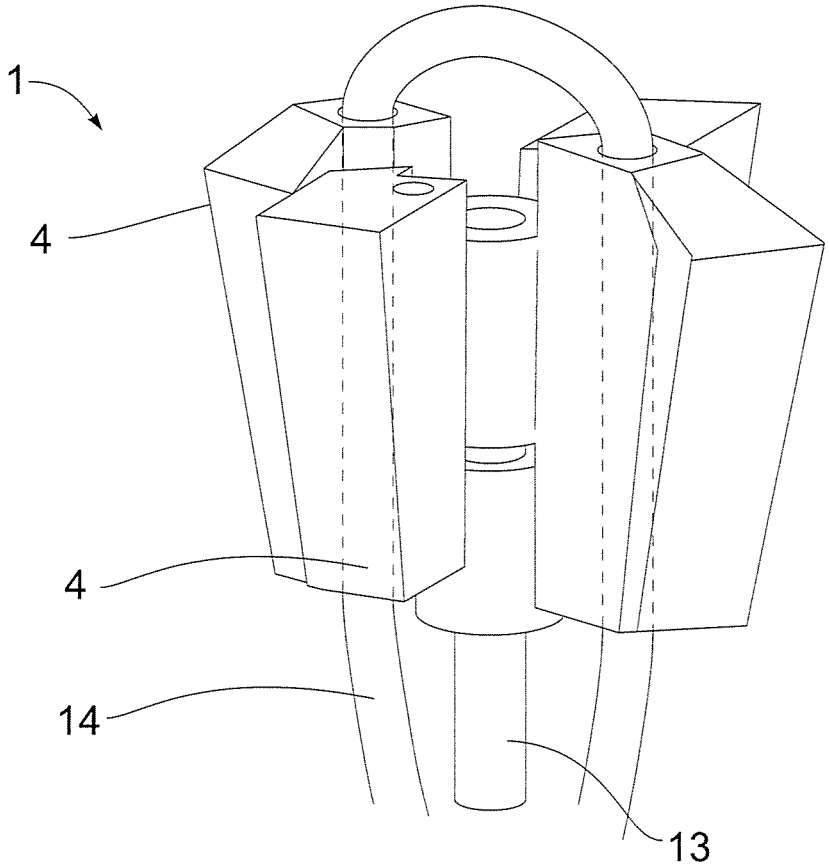

The anchor 1 as shown in FIG. 1 consists of a hinged base 3 which, in the embodiment shown, includes a pair of wings 4, consisting of a first wing 4A and a second wing 4B with a base cover 21 connected to the second wing 4B. In other embodiments there may be more than one wing and/or more than one axis for a wing(s) and this is described later. The anchor 1 has a longitudinal axis 5 which is parallel, or substantially parallel to the load 11 applied to the anchor 1. As will be described a portion of the anchor to which the load is applied, the connecting portion 10, may be flexible, as shown in FIG. 14. In this case the load 11 may be at a tangent to the longitudinal axis due to bending of that flexible portion. However, the load 11, or line of action of the load, applied to the wings 4 will still define a longitudinal axis. This is because in the preferred embodiment shown that portion of the connecting portion 10 that runs through the wings 4 is not, and really cannot be, flexible.

In one form of the anchor 1, there is a shaft 13 centrally extending from one wing pair, from example the first wing 4A, in this case the lower wing, and concentric to the longitudinal axis 5. In the other wing of the pair, in this case the second wing 4B, which is the upper most wing as shown, has a complimentary bore 14 to receive the shaft 13. The result is a hinge that allows the first wing 4A and second wing 4B to rotate relative to each other about the longitudinal axis 5, and also allowing sliding along the longitudinal axis, thus allowing the movement from the first position 6 to the second position 7, which is described below.

In other forms still the shaft 13 may extend all the way from the base cover 21, whether separate or integral thereto.

A locking cap 35 is present which engages with the top of the shaft 13 when assembled to keep the resulting assembled anchor together. This could be achieved in others ways known in the art, but at the very least provides a purchase for the secondary biasing means, for example the linear spring, to act on.

The anchor 1 has a locking mechanism 9 that locks the wings 4 in either the first position 6 or second position 7. The locking mechanism has several parts, cooperating portions 18, locking portion 19, and locking handle 29 (shown in FIG. 8). The locking handle 29, engages the locking portion 19 to de-activate the locking mechanism and allow movement from the first position 6 to the second position 7. Reversing from the first position to the second position requires the sliding the two wings apart in the opposite direction, then rotating to the first position. The ramped nature of the teeth then will move the locking portion 19 up to allow recapturing the first wing 4A.

In the embodiment shown in FIG. 1 there are two first co-operating portions 18A on first wing 4A, and two first co-operating portions 18B on second wing 4B. The first co-operating portions 18A and 18B are extensions out of their respective wings. In FIG. 1 the locations of co-operating portions 18B can be seen on second wing 4B as extensions, in this case curved, out of the wing 4B, either side of the wing 4B. However, this could be any wedge shape as long as the faces of the co-operating portions evenly meet to take the load. Likewise one of the co-operating portions 18A can be seen extending out of the first wing 4A, and there is a further co-operating portion (not shown) extending out of the other side of the wing 4A.

To accommodate the co-operating portions 18A and 18B when in the first or closed state 6, there are complimentary recesses 28 in each wing 4A and 4B opposite the co-operating portion of the other wing. This way the cooperating portion 18A of wing 4A is received into the opposite recess 28B of wing 4B.

In the preferred embodiment shown in FIG. 1 there are further co-operating portions, a pair of cooperating portions 18C (only 1 shown) on first wing 4A and a complimentary pair of co-operating portions 18D (both shown) on the second wing 4B. These are in the form of a castle configuration, the co-operating portions 18D, have recesses 28D either side of them, to receive the co-operating portions 18C from wing 4A when in the open state 7. Likewise co-operating portions 18C, have recesses 28C either side of them, to receive the co-operating portions 18D from wing 4B when in the open state 7.

As shown there are two pairs of first cooperating portions 18A and 18B on each wing 4, and therefore two recesses 28A and 28B, and second so-operating portions 18C and 18D and recesses 28C and 28D. However, there may more or less as needed for the design or physical constraints.

A primary bias, for example a torsional spring 20, is located in the preferred embodiment between the base cover 21 and the first wing 4A. As the base cover is engaged to the second wing 4B as described below, the effect is that the primary bias urges the first wing and the second wing to rotate apart, from the first position towards the second position.

A further part of the locking mechanism is a locking portion 19 as shown in FIG. 1. The main function of the locking mechanism is to release the first wing and second wing and allow them to rotate and slide from the first position to the second, and vice versa from the second to the first, again noting the locking portion does not need to be de-activated to allow movement from the second position back to the first position. In the embodiment shown the locking portion 19 has at least one, and preferably two as shown retaining pins 22 that slidingly engage in wing recesses 31, in this case in the second wing 4B. These prevent the locking portion 19 from rotating relative to the second wing 4B. The locking portion also has at least one, and preferably two as shown, locking teeth 34. These engage in complimentary recesses, similar to those in the second wing. The locking teeth 34 are shorter then then retaining pins 22. The effect is that movement of the locking portion along the longitudinal axis away from the wings, will release the locking teeth 34 from the first wing 4A, whilst the retaining pins 22 are still engaged in the second wing 4B. Disengaging the locking teeth 34 from the first wing 4A then allows its to rotate and initiate movement from the first position to the second position.

The locking portion 19, and in turn the movement of the first wing and second wing along the longitudinal axes toward each other, is achieved by a secondary biasing, for example a linear spring 25, acting along the shaft 13, such that the locking portion 19 remains engaged in the wing, preventing its rotation or sliding until the locking portion 19 is disengaged. In the preferred form the locking portion 19 is disengaged by a locking handle 29, as shown in FIG. 8. The locking handle 29 is pulled by the fingers of a user, in a known way, to slide upwards along the longitudinal axis 5, and is connected 36 to the locking portion 19, thus pulling the locking portion 19 with it and disengaging it from the wing. In the preferred form the connection 36 is a tensile one.

The engagement of the various co-operating portions will be described below with reference to FIGS. 9 through 13.

Figure 2:
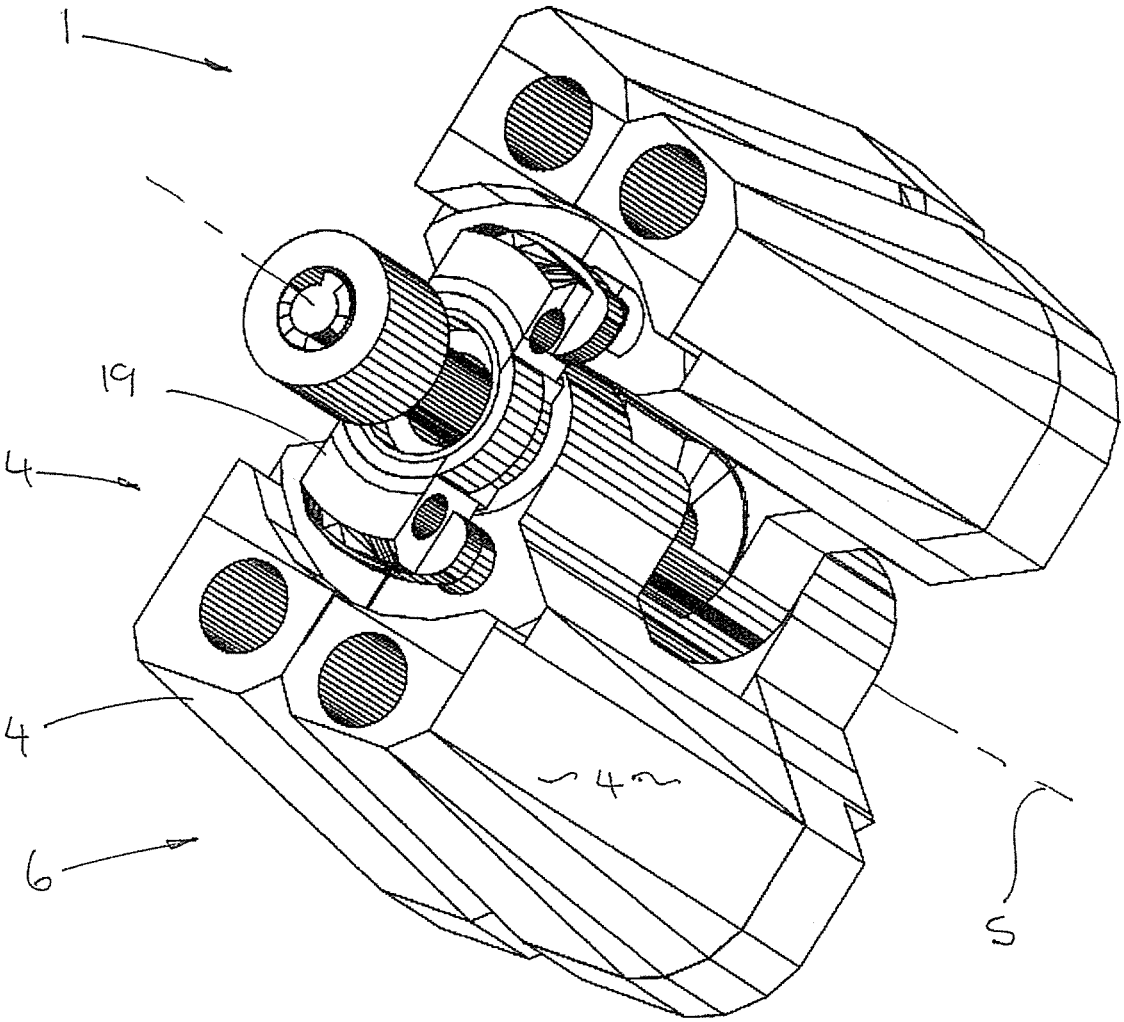
Figure 10A:
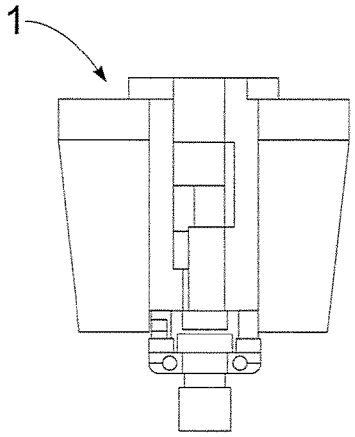
Figure 10B:
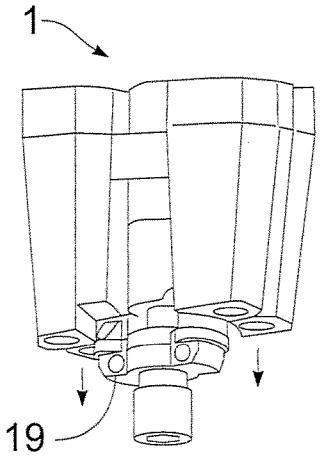
Figure 10C:
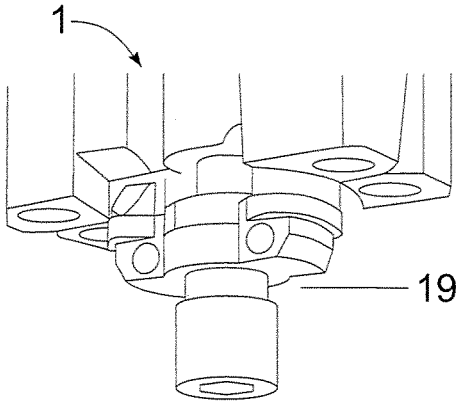
Figure 11A:
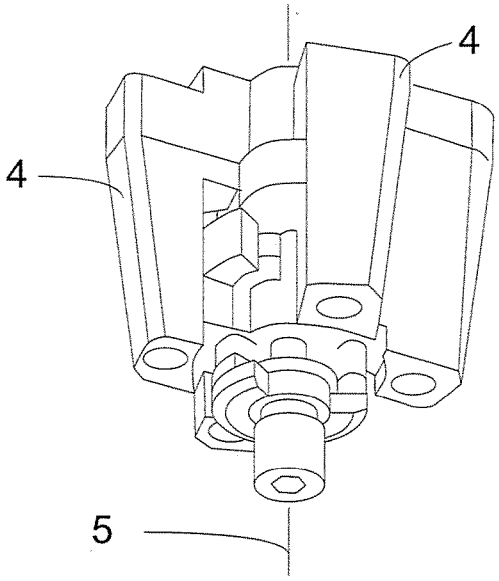
Figure 11B:
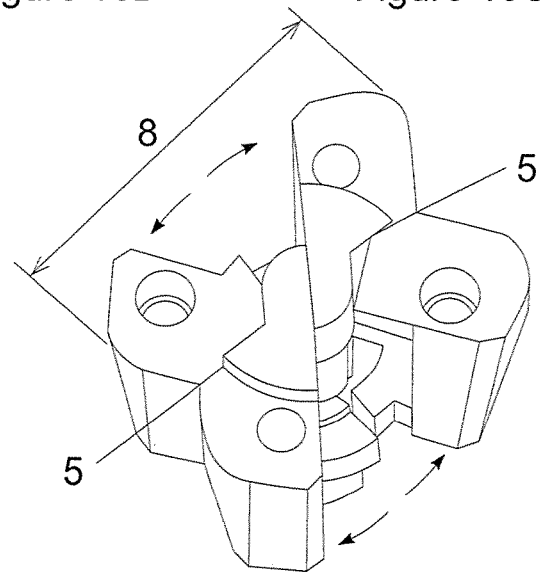

In FIG. 2 the wings 4 are shown in the first position 6, which is a closed state. The second position 7, which is the open state, is shown in FIG. 11B. In moving from the first position 6 to the second position 7, the locking portion 19 is disengaged as shown in FIGS. 10B and C, the wings are then free to rotate about the longitudinal axis 5, under action of the primary bias. The co-operating portions 18A, B, are then freed from their recesses as shown in FIG. 11B. Once free by fully rotating the wings 4 can then slide along or contract along the longitudinal axis 5, under action of the secondary bias thus engaging all the co-operating portions 18A, B, C, and D.

The first wing 4A and second wing 4B rotate about the longitudinal axis 5 and then slide along it. In doing so, then can move from the first position 6 to the second position 7. In some preferred embodiments they can also be locked in any position between the two positions, as will be described later.

Figure 12A:
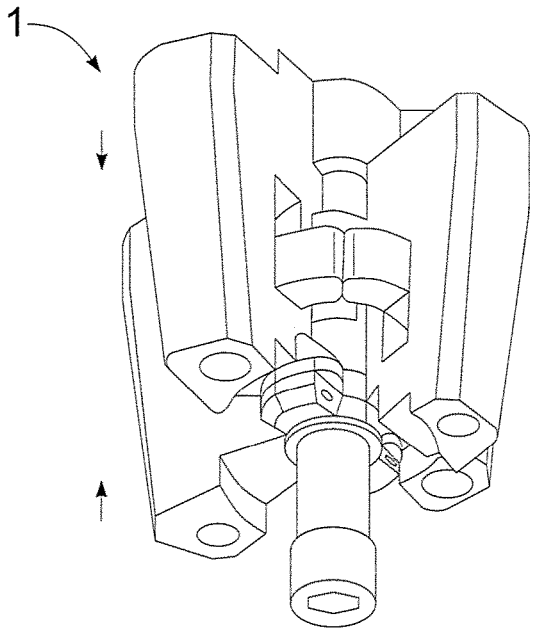
Figure 12B:
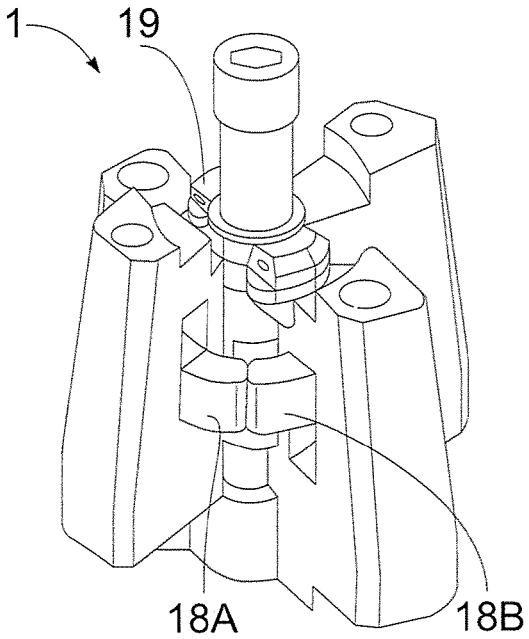
Figure 13A:
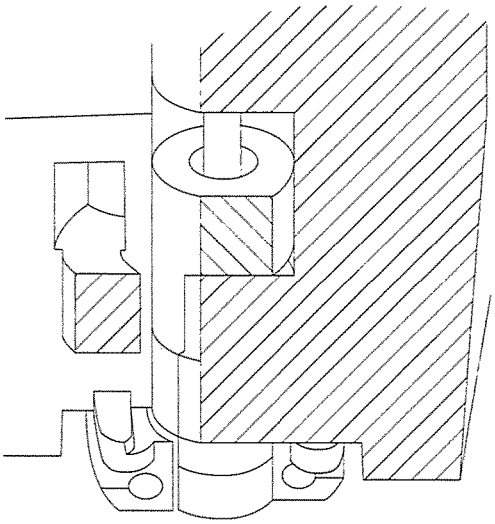
Figure 13B:
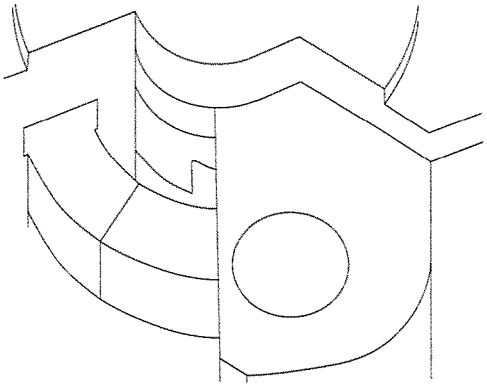

The wings 4A and 4B can then slide relative to each other along the longitudinal axis, as shown in FIG. 12A to allow the co-operating portions 18A and 18B, and 18C and 18D on each wing to then engage and hold the wings in the second position 7 as an 'X_when seen along the longitudinal axis 5, as shown in FIG. 12B. The engagement of the cooperating portions 18A and 18B is shown in FIG. 12B and in close up in FIG. 13B. The wings also engage when in the second position 7 on their second butting faces 37. This, with the co-operating portions 18A, B, C and D then prevents movements rotationally of the wings relative to each other.

This structure imparts the effective capability of the device, the co-operating portions 18A&B, their abutting faces, and the second butting faces of the wings act to distribute the load from the core to the wider body. This significantly increases the strength of the anchor 1.

In the second position 7, the wing pair when seen from along the longitudinal axis has the X shaped configuration, where a dimension 8, shown in FIG. 11B, between opposing parts of each wing 4A and 4B is greater than the dimension 8 when the wings are in the first or closed position 6, as shown in FIGS. 3,4. This variable geometry therefore providing an anchor that has a greater size range due to its ability to change shape than just a single block of material that cannot change shape.

Figure 16:
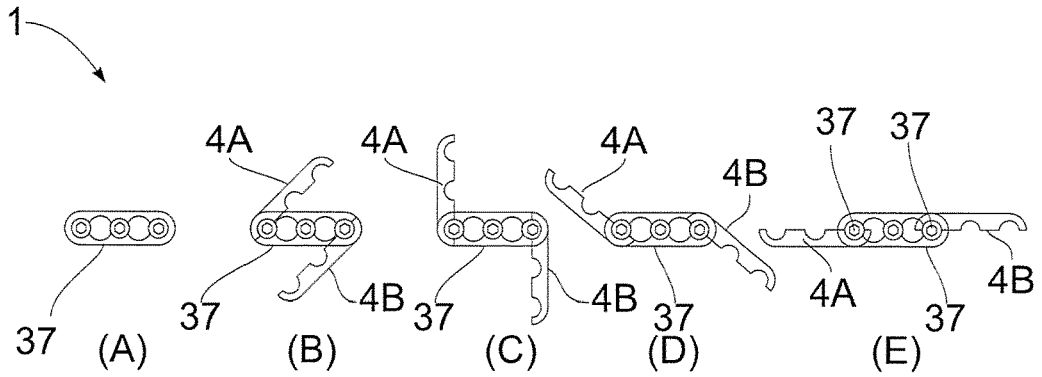
Figure 17:
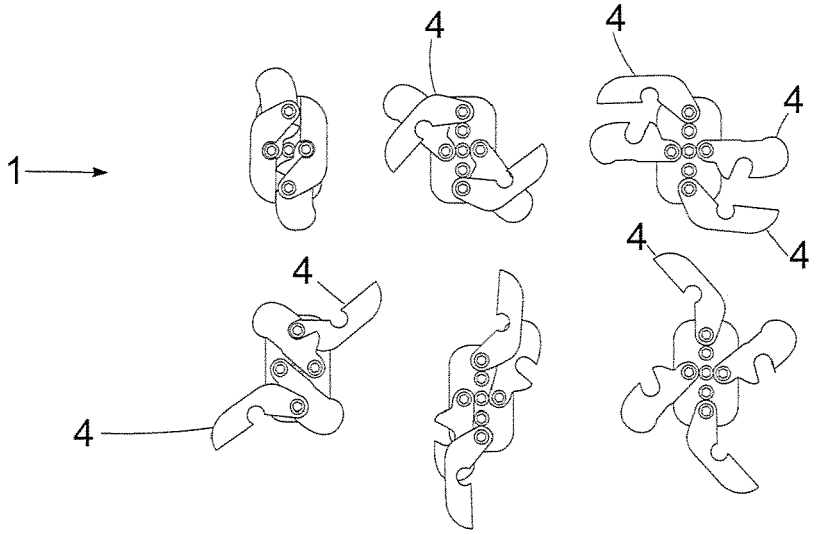

A further variation of the anchor 1 is shown in FIGS. 16 to 25 having two or more wings pivoting about two or more parallel axes. The anchor in one form is shown in FIG. 16 having two wings 4A and 4B respectively, each on its own pivot 38A and 38B respectively. The pivots 38A and B are parallel with the longitudinal axis 5 as described in the earlier embodiment. The wings 4A and 4B, and their respective pivots are contained within a body 37 or base portion. The wings 4 are shown being able to lock, via the locking mechanism 9 (described below) in multiple positions as shown in FIGS. 16A through E.

A further variation of the anchor 1 is shown in FIG. 17, again showing a series of positions the wings 4 can be locked in. The shape of the wings 4, and anchor 1 can be formed at the manufacturing stage for the particular application necessary. Other forms of wings 4 may be available also to swap in and out of the anchor 1, to allow customisation if desired.

Figure 18A:
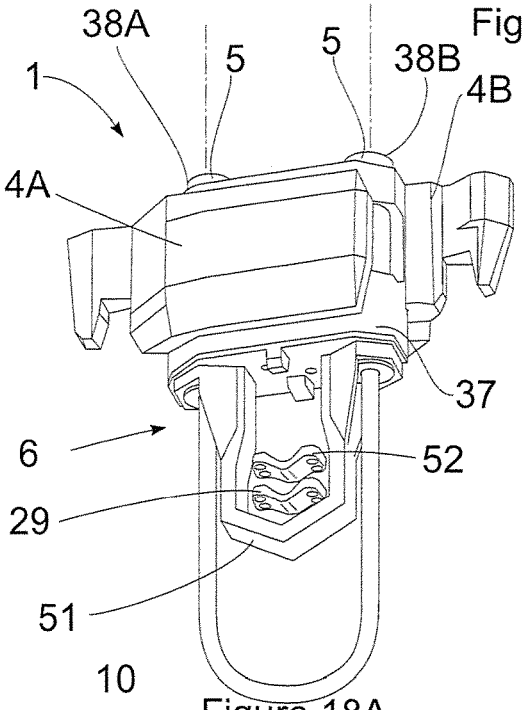
Figure 18A:
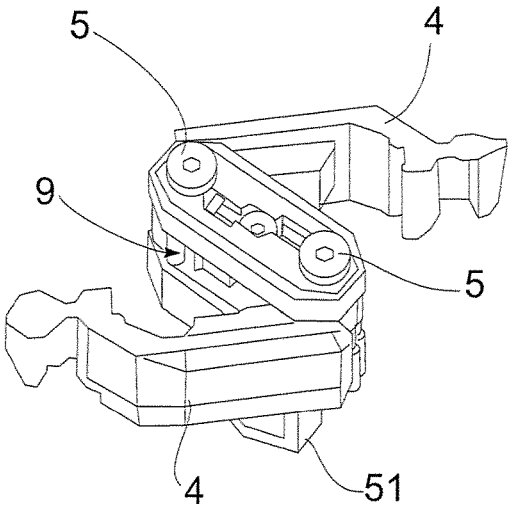
Figure 19A:
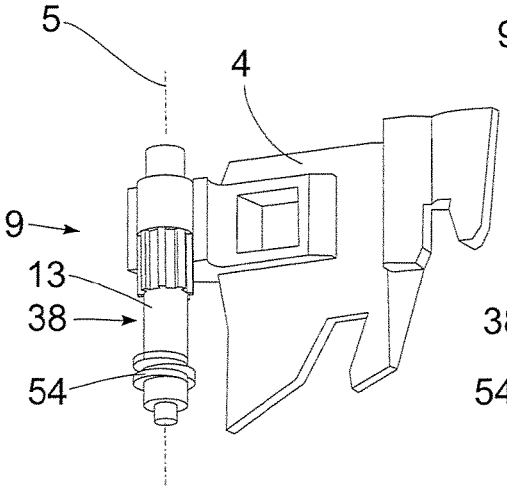
Figure 19B:
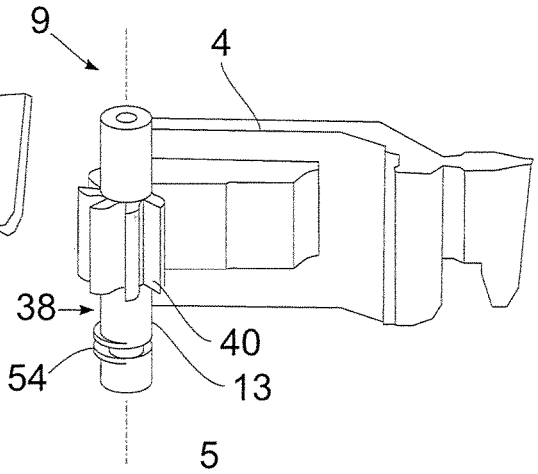

A form of the anchor 1, similar to that of FIG. 16, is shown in FIG. 18A in the closed state 6, and in an open state 7, though not necessarily all the way open, as the wings 4A and 4B can lock at several locations. The wings 4A and 4B, each pivoting on its own pivot 38A and 38B respectively, each pivot running parallel to the longitudinal axis 5. The anchor 1 has a body 37 that holds the pivots and locking mechanism 9. The body has a connecting portion 10 extending from it, from which the load can be connected. The connecting loop 10, can pass through the wings at the pivot locations to form the connecting portion. In such a preferred form the pivots 38 may be hollow to allow the connecting portion to be formed, and for example swages may be used to hold the loop in position such that it cannot pass back through the aperture of the hollow pivot. An optional finger rest 51 is shown, which in the absence of connecting portion 10, may form the connecting portion, that acts as a further grip for the user to activate the locking handle 29 which de-activates and activates the locking mechanism. The locking handle 29 in this embodiment moves along the longitudinal axis 5, and is connected in any convenient way, for example by tensile mean (not shown). A further activation handle 52 is shown which the user can manipulate, for example by pulling, to rotate the wings in or out, preferably out—this is described below.

Two variations of locking mechanisms 9 will now be described. The first in FIGS. 19B, and 20A and B and 22, the second in FIGS. 19A, 21A, B, C, and 23A, B. Both variations have a biasing system (linear spring whether in compression or tension) which (a) holds them in the closed and/or locked position to prevent opening rotation of the wings, at least in one, of both directions of opening or closing, for example it may be desired the wings can move toward the open state from the closed state, without de-activation of the locking mechanism 9. Therefore when the locking mechanism is de-activated the user can return the anchor 1 to the fully or more closed position (unless a further opening force is applied). For example extension springs can be present which act to return the wings to the closed position, and compression springs may act either (a) on the bar of the ratchet (FIG. 20A) or (b) the pin/collar (FIG. 21B) acting on the sleeve to keep the locking mechanism shut—unless a counter acting force is applied, for example by the user directly, or by the locking handle.

Figure 20A:
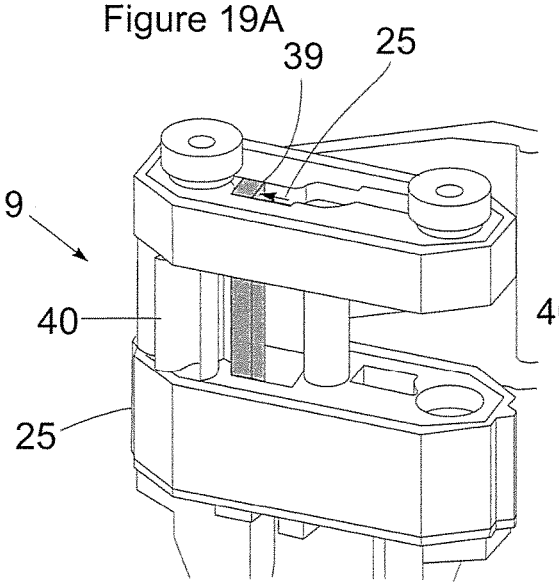
Figure 20B:
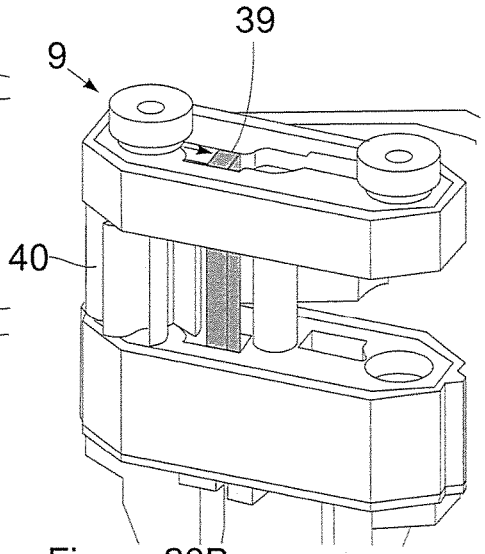

The first variation uses a movable bar 39, which engages, as shown in FIG. 20A, wing complimentary features 40 (shown in FIG. 19B) to prevent movement, and disengages, as shown in FIG. 20B from the features 40 to allow movement. In the form shown the wing 4 can move outward toward the open position without de-activation of the locking system, but can only move inward toward the closed position when the locking mechanism (that is the moveable bar 39) is disengaged, in other words the locking mechanism includes a ratchet mechanism. The movable bar 39 is braced inside the body 37 to take the loading from the wing 4. The movable bar has springs 25 top and bottom (FIG. 20A) keeping it in the locked position unless a counter acting force is applied, for example when the locking handle is used to de-activate the locking mechanism. Activation of the ratchet mechanism, which is one way locking, can be achieved by simply pulling the desired wing toward the desired open position, or may use a further part of a locking handle similar portion, eg a pull ring, which is itself attached to a tensile portion about pivot 38 (lower portion shown in FIG. 19) to pull the wing open. The shape of features 40 means rotation displaces the lock, relocking once rotation is complete.

Figure 21A:
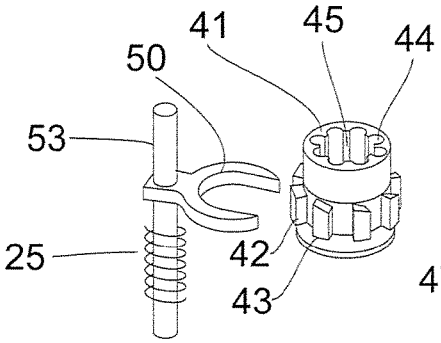

A second variation of locking mechanism uses a sliding sleeve 41 shown in FIG. 21A to lock and unlock the wing. The sleeve 41 has external engaging portions 42 on its outer surface 43, shown here as teeth. There are also internal engaging portions 44 on its internal surface 45, likewise these are teeth also, but both 42 and 44 could be any form desired that functions.

Figure 21B:
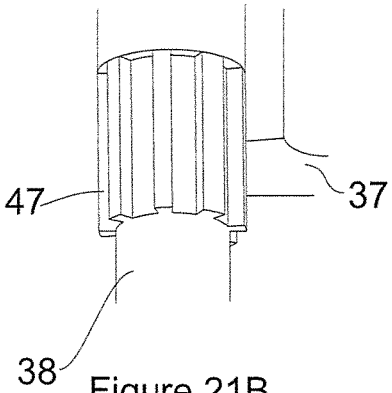
Figure 21C:
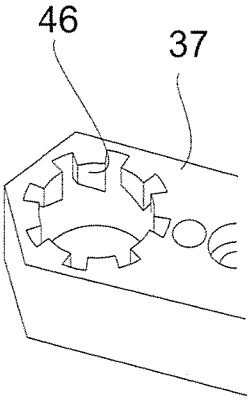
Figure 22:
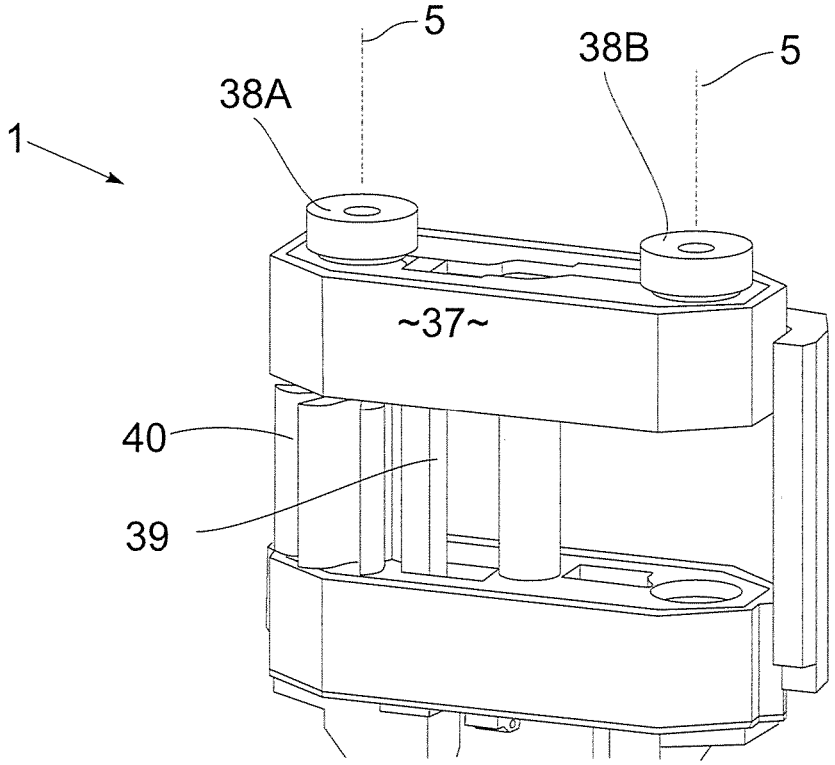

The sleeve 41 is in sliding engagement and disengagement with the body 37 and in particular the external engaging portions 42 engage in base complimentary portions 46, as seen in FIG. 21C. Likewise the internal engaging portions 44 of the sleeve 41 engage and slide on wing sleeve complimentary portions 47, as shown in FIG. 21B, the portions 47 in this case being teeth on the pivot 38 shaft.

Figure 23A:
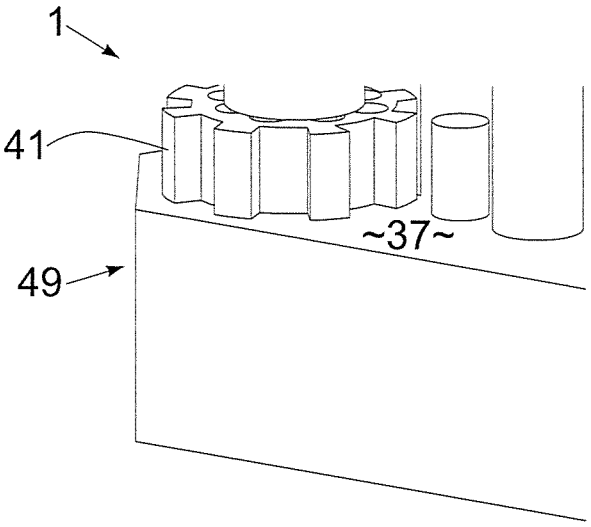
Figure 24:
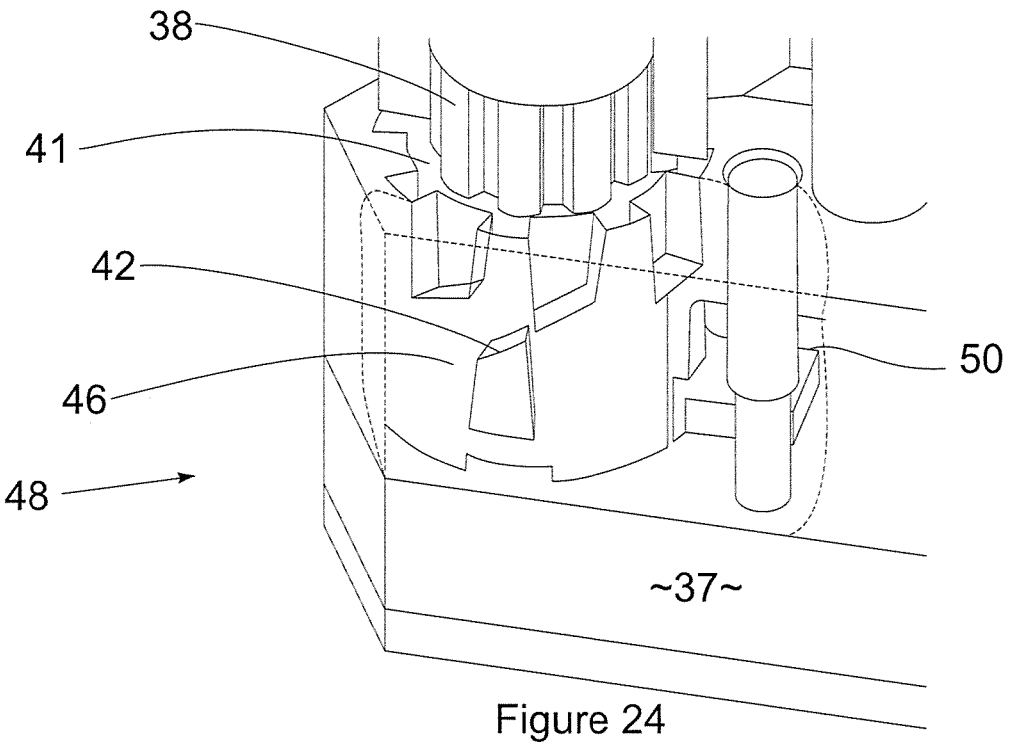
Figure 25:
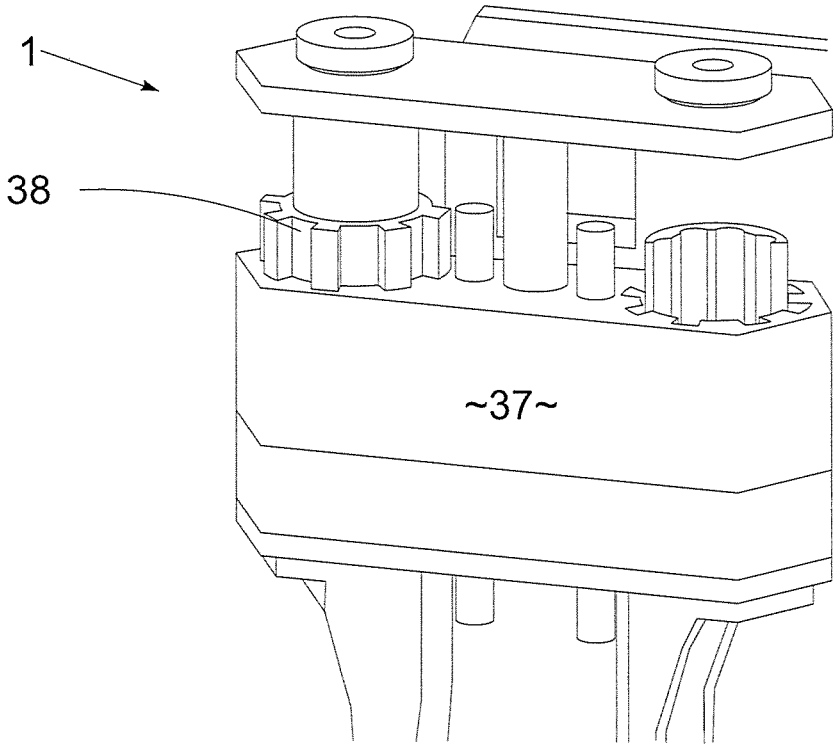

The sliding movement of the sleeve 41 is shown from the second locking position 49 which is fully locked position, shown in FIGS. 23A, B, 25, to the first locking position 48, or fully unlocked position, in FIG. 24, where it is seen the external engaging portions 42 are clear of the base complimentary portions 46.

The sleeve 41 is moved between the first and second positions by the pin 53 and its collar 50, the pin 53 is biased by the compression spring 25 shown in FIG. 21A, in this position the wing cannot rotate.

In the unlocked (and locked) position, the internal engaging portions 44 remain on the pivot 38 and its wing sleeve complimentary portions 47, and the sleeve 41 is shown in the second locking position, 48 (FIG. 24) slid down on the pivot such that the external engaging portions 42 are clear of the base complimentary portions (46). This therefore allows the wings to be rotated about the pivot as desired.

Figure 23B:
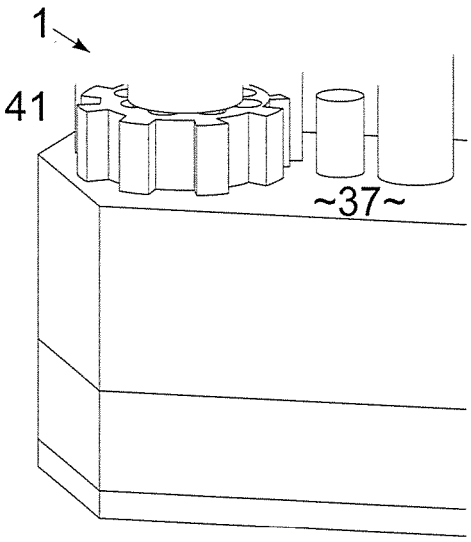

When the locking handle is released, the sleeve 41 then slides back up the pivot to the first locking position 49 as seen in FIG. 23. The external engaging portions 42 then engage with the base complimentary portions 46. This then locks the wing 4 in the desired position to the body 37.

The sleeve 41 can be held in the locked position by a number of ways, for example by a spring 25 (FIG. 21A) acting on the collar 50 that engages about the sleeve 41 to move the sleeve 41 in and out of the first or second locked positions (FIG. 21A), preferably the spring 25 acts to keep the collar 50 in the locked position until de-activated by the locking handle 29, or similar. The collar 50 is in turn acted on by the locking handle, directly or indirectly, to de-activate the locking mechanism the sleeve provides.

Activation of the collar 50 and sleeve 41 locking system (two way locking) requires deactivating the lock (via pulling on the pin 53 FIG. 21A, again for example attached by a tensile means, eg wire cable or rigid connection to the locking handle 29). In one preferred form there is a separate activation handle 52 (or may be combined with the locking handle to activate on the same pull, but after de-activation of the locking mechanism) that acts, for example by a tensile means, eg a flexible wire or similar, on a spindle 54 (FIGS. 19A&B) about the pivot 38 or its shaft 13 to drive rotation of the wing 4. For example the tensile means may be wrapped around the spindle 54 so that pulling the activation handle 52, then pulls on the tensile means which then unwraps from the spindle 54 as the spindle 54 rotates under its action. In this way the user can with one hand, de-activate the locking mechanism, and then move the wings out (or in) to the desired position, before re-activating the locking mechanism to hold the wings in the desired form.

Again the locking mechanism may be of a one way form such that a user may move the wings out as desired without de-activation of the locking mechanism.

Again the wings may be biased by a primary bias, eg a torsional spring, to rotate from the closed to the open position or if desired from open to closed. Likewise a secondary bias, for example a linear spring 25, may hold the sleeve 41, or the movable bar 39 in the engaged position with the wings 4, and the locking handle 29 must act against this to disengage the locking mechanism to allow rotation of the wings 4 from the closed to the open position.

Figure 26:
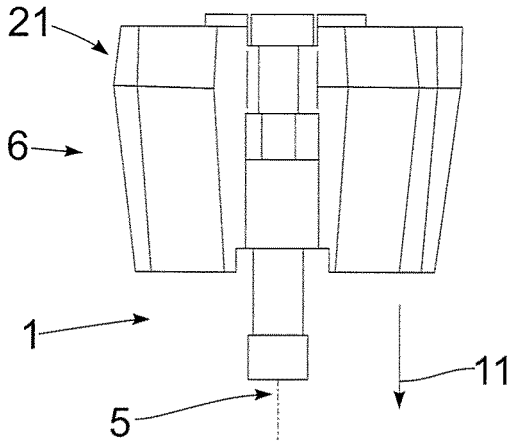
Figure 27:
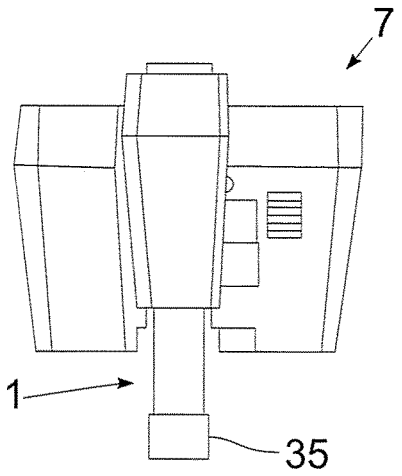
FIG. 27 is the view of FIG. 26 in an open state.
Figure 28:
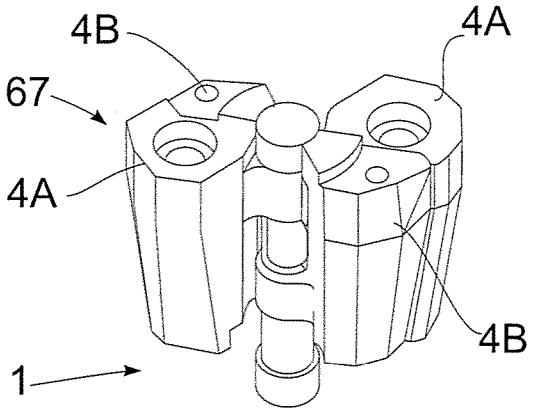
FIG. 28 is a similar view to FIG. 26 in bottom isometric view.
Figure 29:
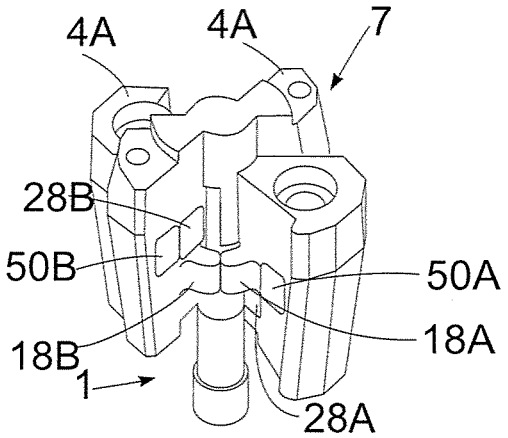
FIG. 29 is the view of FIG. 27 in bottom isometric view.
Figure 30:
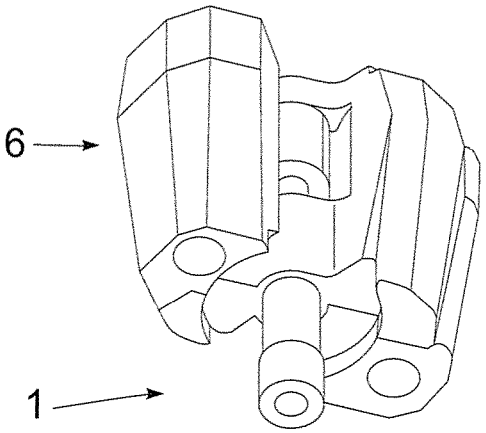
FIG. 30 is a similar view to FIG. 26 in top isometric view.

A further embodiment of the anchor 1 is shown in FIGS. 26 through 31 in the closed state 6 in FIGS. 26, 28 and 30, and in the open state 7 in FIGS. 27, 29 and 30. The embodiment is similar to that shown in FIGS. 1 to 15 with the exception there is no externally actuated locking and unlocking system. The torsion spring that drives the opening biasing force between the two wings is also not present. Similarly there is no separate base cover (21). Like integers in this embodiment are those as described in the earlier embodiment in FIGS. 1 to 15.

Again as shown in FIGS. 26 through 31, the anchor 1 has a trapezoidal shape when viewed from the sides. This shape tapers from the base of the wings 4 to become narrower towards the top of the wings 4 as shown. This shape has the natural advantage of engaging with the rock 2, or similar, and wedging itself in place where the rock, or similar, narrows, as seen in FIG. 15. The wings 4, as shown when in the closed state 6 present a different size of trapezoid when seen from the side as in FIGS. 26, 28 and 30 when compared to FIGS. 27, 29 and 31. This conveys the natural advantage of providing at least two multiple sizes (long and short axes) of hinged base 3 in the one anchor 1. In other forms of the present invention the trapezoidal shape may vary on each of the 4 sides to convey more sizes of hinged base 3. Alternatively the side shape formed, for example a trapezoid, may be the same from all sides. The hinged base 3, and therefore at least in part the wings 4, may be further sculpted as needed to provide better purchase in the rock 2. For example there may be added concavities or convexities, the side profiles may be curved or have other forms as desired to provide a better anchor.

The anchor 1 as shown in FIGS. 28 and 29 consists of a hinged base 3 which, in the embodiment shown, includes a pair of wings 4, consisting of a first wing 4A and a second wing 4B with a base that connects to the second wing 4B. In other embodiments there may be more than one wing and/or more than one axis for a wing(s) and this is described later. The anchor 1 has a longitudinal axis 5 which is parallel, or substantially parallel to the load 11 applied to the anchor 1. As will be described a portion of the anchor to which the load is applied, the connecting portion 10, may be flexible, as shown in FIG. 14. In this case the load 11 may be at a tangent to the longitudinal axis due to bending of that flexible portion. However, the load 11, or line of action of the load, applied to the wings 4 will still define a longitudinal axis. This is because in the preferred embodiment shown that portion of the connecting portion 10 that runs through the wings 4 is not, and really cannot be, flexible.

In one form of the anchor 1, there is a shaft 13 centrally extending from one wing pair, from example the first wing 4A, in this case the lower wing, and concentric to the longitudinal axis 5. In the other wing of the pair, in this case the second wing 4B, which is the upper most wing as shown, has a complimentary bore 14 to receive the shaft 13. The result is a hinge that allows the first wing 4A and second wing 4B to rotate relative to each other about the longitudinal axis 5, and also allowing sliding along the longitudinal axis, thus allowing the movement from the first position 6 to the second position 7, which is described below. These features for the embodiment shown in FIGS. 26 to 31 are the same as that shown in FIG. 1.

In other forms still the shaft 13 may extend all the way from the base cover 21, whether separate or integral thereto. In later forms the shaft (13) is a 25 mm M2 bolt-pin threaded through the lower wing (4*b*) into the upper wing 4(*a*,) this keeps assembly together and anchors compression spring.

A locking cap 35 is present which engages with the top of the shaft 13 when assembled to keep the resulting assembled anchor together. The locking cap 35 secures the secondary biasing means, the two wings are interlocked by the base cover 21. This could be achieved in others ways known in the art, but at the very least provides a purchase for the secondary biasing means, for example the linear spring, to act on.

The anchor has a locking mechanism similar to the embodiment of FIGS. 1 to 15 with the exception there is no external actuating mechanism to activate and deactivate the locking mechanism. The movement of the wings 4 from the closed state 6 to the open state 7 follows the same movement path as earlier described. Namely the wings 4A and 4B rotate relative to each other about the axis 5 until the co-operating portions 18A and 18B from each wing 4A and 4B respectively are clear of their opposing recessing 28B and 28A in the opposing wing. P resent also are co-operating portions 18C and 18D and these must also be aligned so they are clear of each other as described with the first embodiment. Once all the cooperating portions are aligned including, additional (upper) radial buttressing, for example in FIG. 38, the wings 4A and 4B can slide mutually toward each other along axis 5. Once they slide all the way the cooperating portions 18A and 18B are opposite each other and bear on each other to prevent any further rotation. Likewise the cooperating portions 18C and 18D are locked into each other to also prevent further rotation.

The wings are held in the open position by the mutual friction between them, about the shaft 13, and the cooperating portions 18A against 18B, and 18C against 18D. The wings are also prevented from further rotation in the opposite direction when in the second position by the engagement of their second butting faces 37. The linear biasing force of the compression spring (or applied downwards load) keeps the co-operating portions fully engaged.

To reverse the anchor 1 from the open state 7 to the closed state 6 the process is reversed, the wings are slid axially along the axis 5 until the co-operating portions 18 are clear of each other, and then the wings can be rotated about the axis 5 to the closed position.

A biasing means may also be present to urge the wings to slide mutually toward each other as described for the first embodiment.

Figure 31:
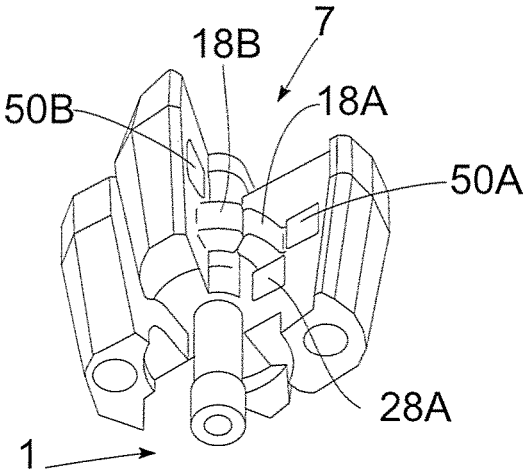
FIG. 31 is a similar view to FIG. 27 in top isometric view.

Present also are engaging sections 50A and 50B on wings 4A and 4B respectively as shown on FIGS. 29 and 31. These are mutually contoured to located each inside the opposite one when the wings 4 are in the closed state. These are an example only of how entire wing faces can be contoured to maximise wing-wing friction in varying states, in this case the closed state.

Figures 34A, 34B, 34C, 34D, 34E:
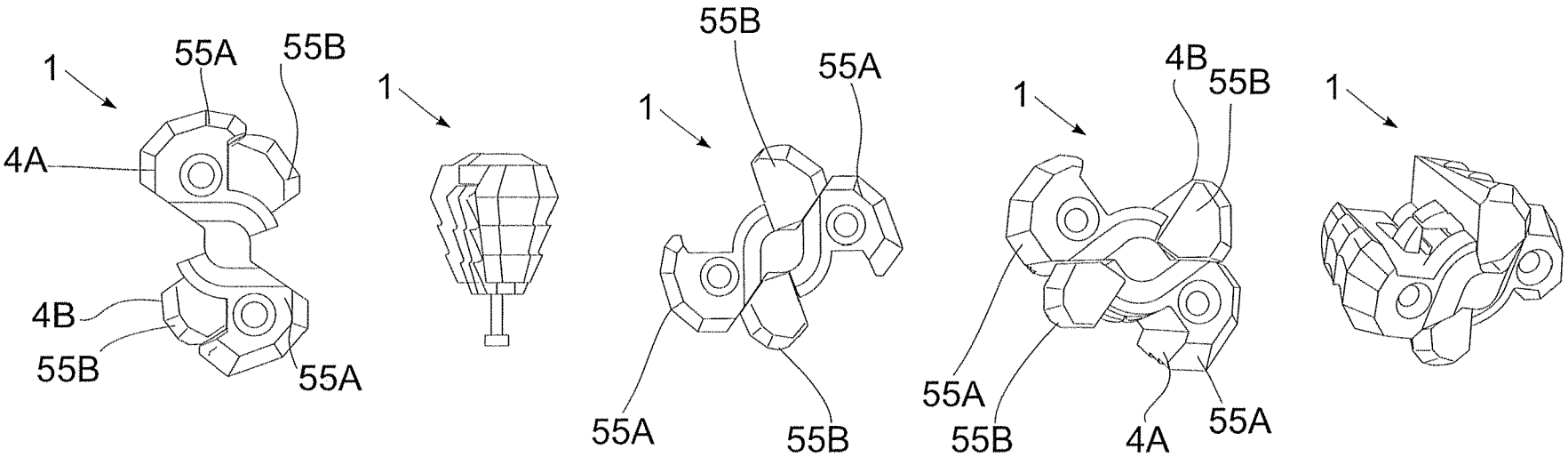
FIG. 34 shows the variation of FIGS. 26 to 31, with a first wing having lobes of one size, and the second wing having lobes of a second differing size, and additional contouring, and shows at (A) the anchor in the closed state from above, (B) side view in closed state, (C) plan view in open state, (D) top isometric view in open state, and (E) a side isometric view in open state, FIG. 35 the variations in size that are available for the closed and open positions are shown in (A) closed, and (B) open for an anchor with substantially similar sized wings and lobes, FIG. 36 the variations in size that are available for the closed and open positions are shown in (A) open, and (B) closed for an anchor with a wing with one size of lobes, and a wing with different sized lobes.

A further set of variations of the anchor is shown in FIGS. 32 to 34 using the mechanism of FIGS. 26 to 31. In these variations there is a symmetrical form shown in FIG. 32 where the wings 4A and 4B are of substantially equal width with equal sized lobes 55, FIG. 33 with equal and opposite sized wings 4, with differing lobe 55 sizes, and FIG. 34 where the wings 4 are of differing size and each one wing 4A has lobes 55A of a differing size (4 different sized lobes in all). These variations of wing size and lobes can be advantageous when an even sized wing and lobe anchor is loaded in a way in the crack in a less than desirable way. For example all load may be applied to only one of the wings 4 of the device.

Shown is the shaft 13, which in the variations shown in FIGS. 32 to 34 is a bolt that passes through the bore 14 on the first wing 4A, and threads into the second wing 4B such that the first wing 4A can slide up the shaft 13, and rotate about it, and then slide back down it. A linear spring 25 is shown in FIG. 32B which biases the 4A toward the second wing 4B. This, together with the nested cooperating portions prevents unwanted movement of the wings 4 relative to each other.

The method of activation in the variations shown in FIGS. 32A through E for example. A user, holding the connecting portion (not shown) but for example is a wire passing through bores 60, can rotate wing 4A away from wing 4B until the cooperating portions 18 are disengaged, for example from their receiving portions in the wing. The linear spring will then slide wing 4A upwards for example in FIG. 32B and the cooperating portions and wing exterior faces are engaged.

Figure 32E:
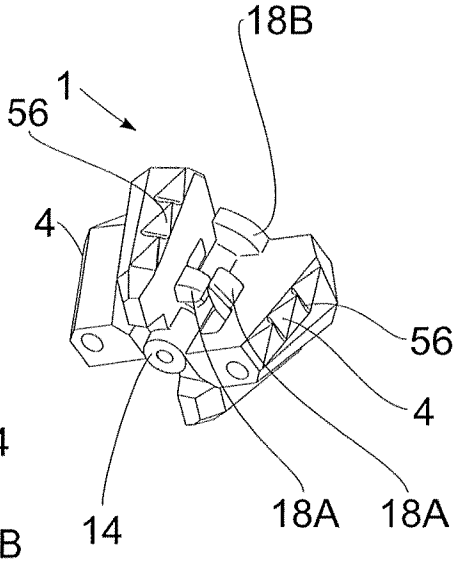
FIG. 32 shows the variation of FIGS. 26 to 31, with wings and lobes of substantially similar size, and additional contouring, and shows at (A) the anchor in the closed state from above, (B) side view in closed state, (C) plan view in open state, (D) top isometric view in open state, and (E) a side isometric view in open state.
Figure 32D:
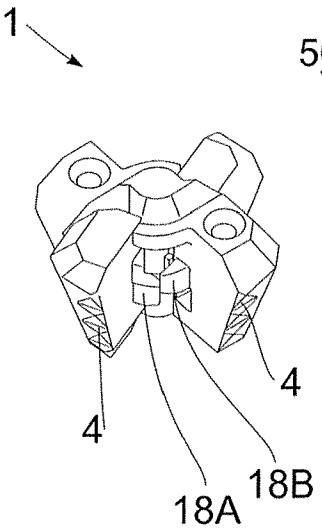
Figure 32C:
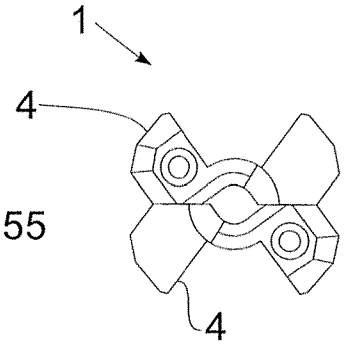
Figure 32B:
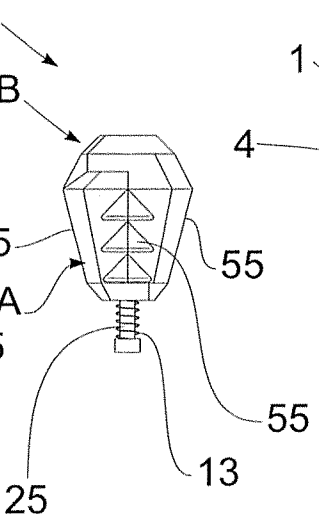
Figure 32A:
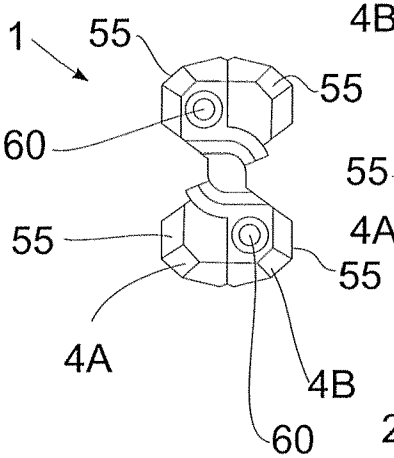

To reverse and close the anchor 1 the user simple does the reverse of the above, pulls wing 4A against the bias of the spring 25, and then when the cooperating portions 18 are disengaged the user can rotate the wing 4A as seen in FIG. 32B, towards the wing 4B and the cooperating portions 18 then nest in their receiving portions (visible in FIG. 32E) in the other wing.

The cooperating portions 18 could be half portions 18A as shown in FIGS. 32D and E, and also may be full portions 18B as seen in FIGS. 32D and E.

The anchor 1 is also shown with contours 56 to aid in engagement and retention in the rock or similar material. These contours may be as shown as reliefs into the wings 4, but may take other forms as needed such as extensions, dimples, protrusions or similar depending on the rock or other material form and substance, or by contrast be completely smooth.

In FIGS. 33 and 34 loading is addressed by having the larger wing 4 or lobe 55 partially encompass the smaller such that if the an anchor 1 is set in a crack such that load is applied to only one part of the device, it is by design on the larger stronger part, for example the larger wing or lobe. Further variations are envisaged which will still fall within the scope of this invention as they will use the same operating mechanism to move between the first position and the second position.

FIG. 33 shows an anchor 1 with wings 4A with a larger lobe 55A and a smaller lobe 55B, and likewise the other wing 4B has a larger lobe 55A and a smaller lobe 55B.

A further variation is shown in FIG. 34 showing an anchor 1 with wings 4A with larger lobes 55A and other wing 4B has smaller lobes 55B, to better load the anchor 1 for a particular crack size and also provide more range of size between closed and open as described below.

Figure 35A:
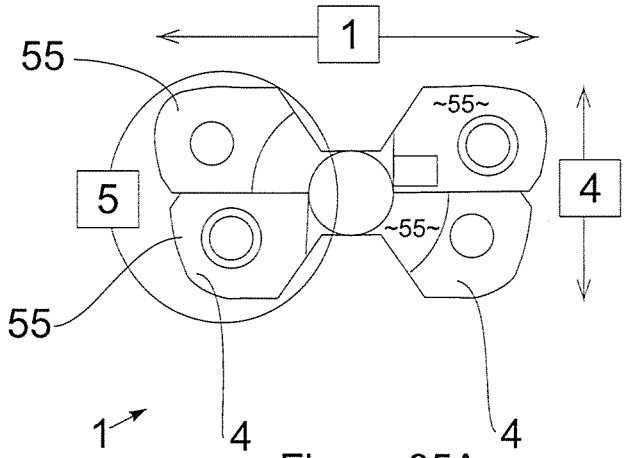
Figure 35B:
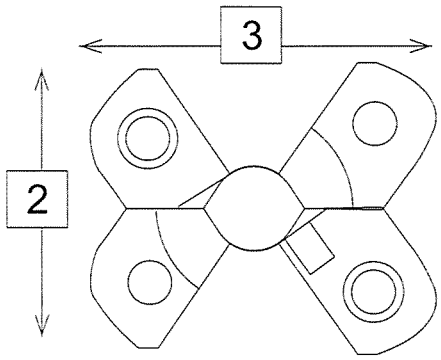
Figure 36A:
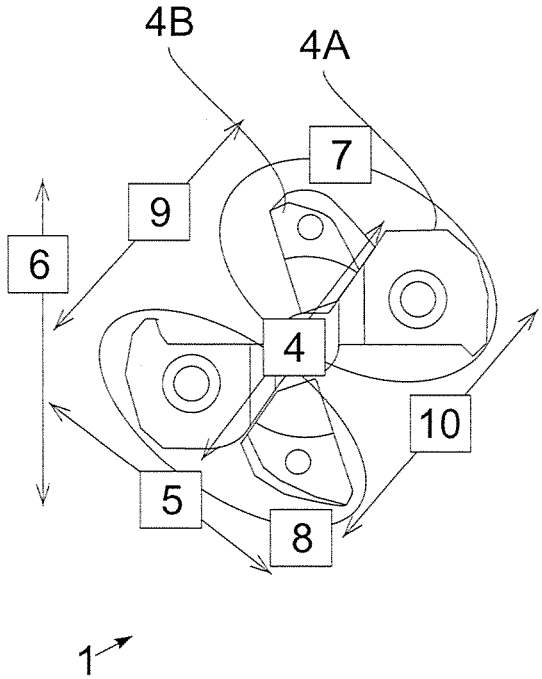

The change in size of the wings 4 of substantially the same size in moving from the first position to the second position is shown in FIG. 35A closed and B open, and the change in size of the variation shown in FIG. 34 is shown in FIG. 36A open and B closed when moving from the first position to the second position respectively. With the anchor 1 of FIG. 32 with two equal wings 4 and lobes 55, the variation is essentially two-fold, the longest (1) and shortest (4) dimensional axes in the closed position in FIG. 35A, with two intermediate dimensions (2 & 3) in the open position in FIG. 35B.

Figure 36B:
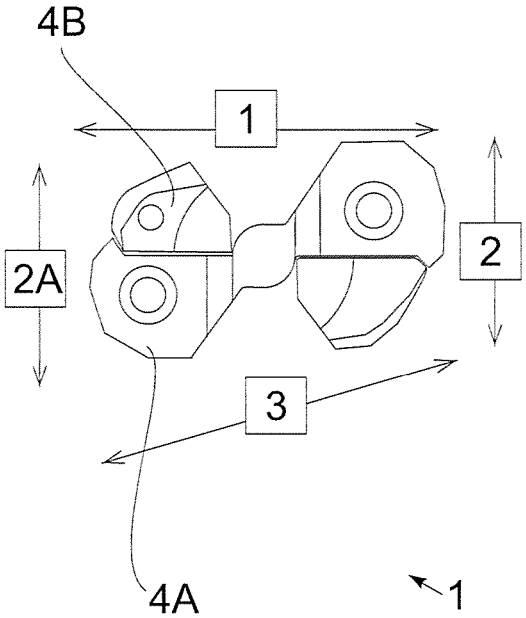

In contrast in the variation shown in FIGS. 33 and 34 with uneven wing dimensions there are more than two principal axes as shown in FIG. 36B closed with longest (1) shortest (2 & 2A), and an intermediate dimensions (3) giving three or more size applications in the closed position. When rotated into the second or open position as shown in FIG. 36A, applying a multiplier of two, the uneven lobes again give a larger range of size applications, two new principle axes (4 & 5), across the smaller individual wing (6), across the individual paired lobes; short axis of touching wings (7 & 8), and across long axes (9 & 10).

Therefore an advantage is gained with varying wing 4 and lobe 55 sizes in the anchor 1 in that the anchor 1 will provide a greater number of sizes when in the closed and open positions.

In the closed state forces acting to compress the device :face to face—(short axis) are opposed by the mechanical/material properties of the two wings—acting as a wedge in a crack it is essentially solid, a wedge that cannot otherwise compress or move any further to close.

In the closed state along the long axis, depending on individual design either (1) a minimum of 3 contact points will act to distribute load across the entire body or, (2) load can be applied entirely to one half wing or nut if it is set in such a way, not a preferred technique unless using anchors with varying wing size or lobe size types.

In the open state the combined unit is locked in place by the interconnected co-operating portions or buttressing portions of the body preventing further rotation in either direction—upwards relative linear movement is required to unlock the device and this is opposed both by the locking spring and any external loads applied.

Figures 37A, 37B, 37C, 37D, 37E:
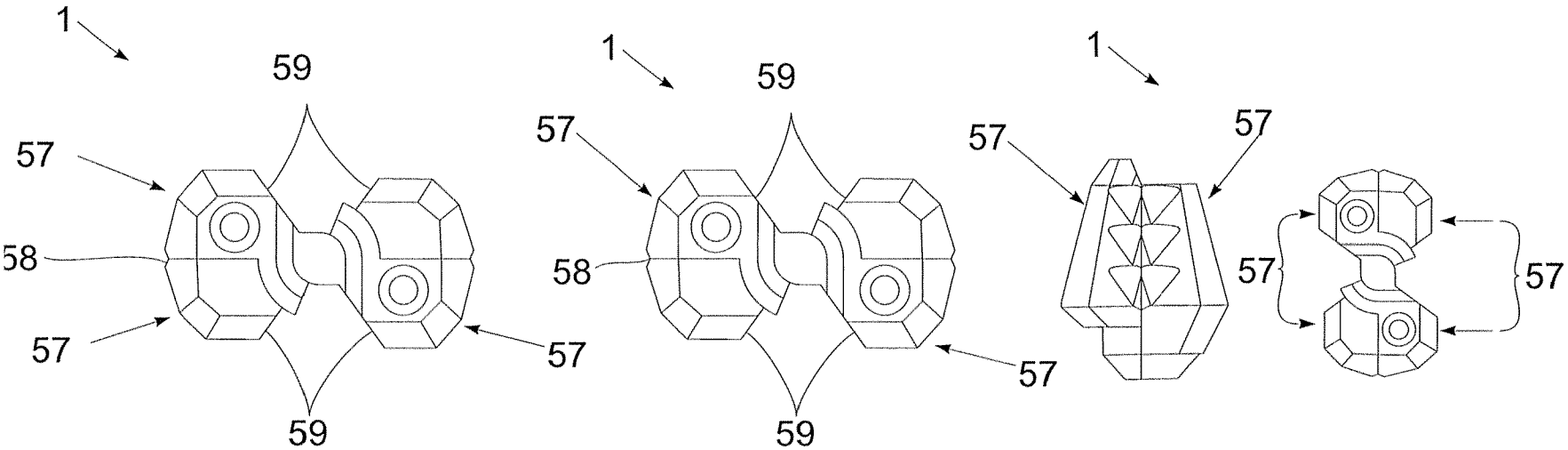
FIG. 37 shows the various forms of loading of an anchor in the closed position with (A) 3 point loading shown from above, (B) two point diagonal loading shown from above, (C) two point loading shown from the side, and (D) four point loading shown from above.

The various loading variations are shown in FIG. 37 in the first or closed position, and in the second or open position in FIG. 38. Force loads 57 from contact with the rock or other material are applied to the anchor 1 at the contact points in the setting crack.

In the closed state the anchor 1 is essentially solid, resistance to applied load 57 is primarily via material properties of the anchor wings, their interior wing faces 58 engaging and buttressing, and the co-operating portions that penetrate from one wing into another.

In the open state as shown in FIGS. 38A through G the applied load 57 is distributed over the wider body by exterior wing faces 59 of the wings 4 rotating into contact to form radial buttressing or reinforcement.

Figure 38A:
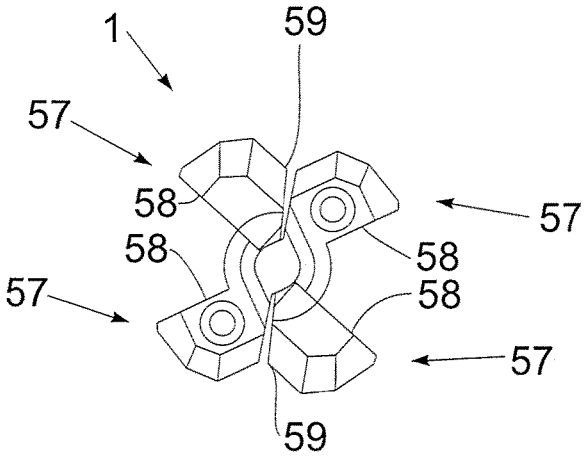
FIG. 38 shows various loading conditions for the anchor when in the open condition at (A) four point loading from above, (B) isometric plan view of four point loading and the support that occurs from the cooperating portions, (C) plan view of buttressing support of the opposing wing pair when open, (D) bottom view of FIG. 38C, (E) plan view of wings with unequal lobes and the buttressing, (F) isometric view of FIG. 38E showing both the upper and medial cooperating portions acting to support the device against applied, and (G) a further view of FIG. 38E, showing the buttressing between two wings exterior face.
Figure 38B:
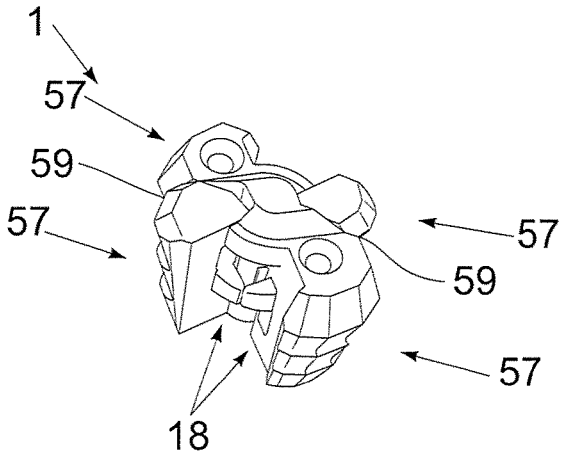
Figure 38C:
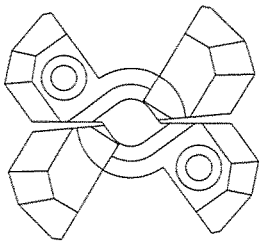
Figure 38D:
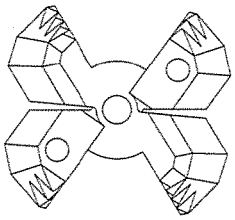
Figure 38E:
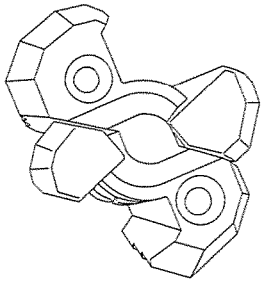
Figure 38F:
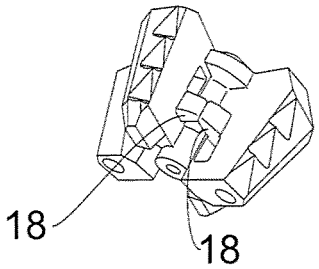
Figure 38G:
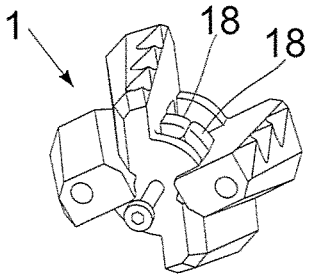

In FIGS. 38B & F the co-operating portions 18 are shown engaged, and in FIG. 38A and the buttressing that occurs between the exterior wing faces 59 is shown. More surface area in the buttressing zone of these faces can be provided to improve strength if needed, or indeed additional radial supports, whether placed at the top, bottom or various medial positions on the device, or it can be removed if not needed to make a lighter anchor 1. Engaging sections as earlier described may also be present on the exterior wing faces 59 as necessary.

When the connecting portion 10 is a wire or similar it may be stiff enough of itself to hold the anchor and allow location. However in lighter anchors 1 the connecting portion 10 when a wire of similar may not be stiff enough. In this case there may be sleeves or sheaths added about the wire immediately below the anchor 1. These improve performance by giving the hand something rigid to brace against while moving the anchor 11 between open and closed states, especially with the smaller wires.

The foregoing description of the invention includes preferred forms thereof. Modifications may be made thereto without departing from the scope of the invention.

The invention claimed is:

1. An anchor for a material comprising:

a hinged base, which base consists of at least a pair of pivotally connected wings, the pivotally connected wings able to pivot about at least one longitudinal axis between, a first position in a closed state and a second position in an open state, the open state having a dimension between opposing parts of each pivotally connected wing that is greater than when in the closed state, a locking mechanism to lock the pivotally connected wings in either the first position, or the second position, a connecting portion connected to the hinged base and adapted to enable a load to be connected to the anchor, the connecting portion having a loading axis which is substantially parallel to the longitudinal axis, wherein the anchor can be set between either the first position, or the second position, and then anchored into the material to enable the load to be connected to the anchor.

2. The anchor as claimed in claim 1 wherein the locking mechanism can lock the pivotally connected wings in any position between the first position and the second position.

3. The anchor as claimed in claim 1 wherein the anchor can be located in a crack or similar in the material and then set from the first position to the second position prior to anchoring.

4. The anchor as claimed in claim 1 wherein the anchor can be placed in the material by a user only using one hand.

5. The anchor as claimed in claim 1 wherein the locking mechanism can be de-activated to allow movement from the first position to the second position, by one hand only of a user.

6. The anchor as claimed in claim 1 wherein a pivot from the first position to the second position, when the locking mechanism is de-activated, consists of a relative rotation of a first wing of the pair to a second wing of the pair about the longitudinal axis, and then a relative sliding between the first wing and the second wing along the longitudinal axis.

7. The anchor as claimed in claim 6 wherein the first wing of the pair has a shaft extending therefrom, and the second wing of the pair has a complimentary bore to receive the shaft to provide a pivot there between to allow a pivot about and along the longitudinal axis.

8. The anchor as claimed in claim 6 wherein a first and second wings of the pair both have a bore therein to mount on and rotate about a separate shaft.

9. The anchor as claimed in claim 8 wherein a shaft and bore act as a guide for the relative rotation about the longitudinal axis, and the relative sliding of the first wing and second wing along longitudinal axis.

10. The anchor as claimed in claim 6 wherein the locking mechanism includes co-operating portions, at least one on each of the first wing and second wing, the co-operating portions supporting the first wing and the second wing in the second position when the locking mechanism is activated.

11. The anchor as claimed in claim 10 wherein de-activation of the locking mechanism at least disengages the co-operating portions to allow the pivotally connected wings to move from the first position to the second position, and vice versa.

12. The anchor as claimed in claim 6 wherein de-activation of the locking mechanism is achieved by a locking portion disengaging with the first wing, or the second wing, to then allow the relative rotation and then a relative sliding.

13. The anchor as claimed in claim 12 wherein there is a locking handle, at or toward an end of the connecting portion distal from the hinged base, that acts on the locking portion, to allow de-activation and activation of the locking mechanism.

14. The anchor as claimed in claim 13 wherein the locking handle is a pull loop or ring.

15. The anchor as claimed in claim 13 wherein the locking handle and locking portion move parallel to the longitudinal axis.

16. The anchor as claimed in claim 13 wherein the locking handle has at least a tensile connection to the locking portion.

17. The anchor as claimed in claim 10 wherein the co-operating portions on each wing can engage each other, after the relative rotation of each of the wings, by the relative sliding to lock the wings in the second position.

18. The anchor as claimed in claim 10 wherein the co-operating portions on each wing of said pair of pivotally connected wing can dis-engage each other, after the relative sliding to un-lock the wings from the second position, then relative rotation of each of the wings to the first position.

19. The anchor as claimed in claim 16 wherein the pair of pivotally connected wings are biased to move from the first position to the second position when the locking mechanism is de-activated.

20. The anchor as claimed in 19 wherein the biasing is by a primary biasing means for rotation, and a secondary biasing means for a relative sliding.

21. The anchor as claimed in claim 20 wherein the secondary biasing means is a linear spring acting parallel to the longitudinal axis to cause the relative sliding of the first wing and the second wing to then engage co-operating portions.

22. The anchor as claimed in claim 20 wherein the secondary biasing means also acts against a locking portion and thus a locking handle.

23. The anchor as claimed in claim 20 wherein the primary biasing means is a torsion spring mounted about the longitudinal axis to cause the relative rotation.

24. The anchor as claimed in claim 23 wherein the torsion spring is located between a base portion and the first wing, such that the first wing rotates relative to the base portion when the locking mechanism is de-activated.

25. The anchor as claimed in claim 10 wherein the co-operating portions consist of at least one extension from the first wing orthogonal to the longitudinal axis, the at least one extension can be received into a complimentary recess in the second wing when in the first position.

26. The anchor as claimed in 25 wherein the at least one extension comprises at least two extensions, one from each of the first wing and the second wing that are received into complimentary recesses, one each on the first wing and the second wing, when in the first position.

27. The anchor as claimed in claim 26 wherein the at least two extensions engage each other on their facing surfaces when in the second position.

28. The anchor as claimed in claim 1 wherein the wings, at least when in the first position, together form a trapezoidal shape when seen from a side.

29. The anchor as claimed in claim 28 wherein the wings taper inwards to form a trapezoidal shape from an end distal from the connecting portion.

30. The anchor as claimed in claim 1 wherein the wings, when in the second position form an "X" configuration when seen along the longitudinal axis.

31. The anchor as claimed in claim 6 wherein the locking portion is slidingly engaged with the second wing via retaining pins, and slidingly engaged with the first wing via teeth that are shorter than the retaining pins.

32. The anchor as claimed in claim 31 wherein the locking portion when slid along the longitudinal axis, away from the first wing and the second wing, disengages the teeth from the first wing to allow it to then rotate, but remains engaged with the second wing via the retaining pins.

33. The anchor as claimed in claim 1 wherein the connecting portion is at least in part flexible.

34. The anchor as claimed in claim 24 wherein the connecting portion is a single length of wire rope, or similar, that runs from the base portion to an end distal to the base portion which then terminates in a loop or similar to allow connection of the load.

35. The anchor as claimed in claim 24 wherein the connecting portion is a loop of wire rope, or similar, that runs from the base portion, through one arm of a first wing, to an end distal to the base portion, and back again through a second arm of the first wing, so forming a loop to allow connection of the load distal from the base portion.

36. The anchor as claimed in claim 24 wherein there are apertures through the first wing, or the second wing and base portion, or both, which the connection portion can pass through and be connected to.

37. The anchor as claimed in claim 24 wherein the locking mechanism involves a movable bar located on the base portion, which engages with complimentary features on a wing to allow pivoting when dis-engaged, and prevent pivoting when engaged.

38. The anchor as claimed in claim 37 wherein the locking mechanism is one-way locking mechanism that allows opening without de-activation of the locking mechanism, but prevents closing without de-activation of the locking mechanism.

39. The anchor as claimed in claim 24 wherein the one-way mechanism is a ratchet system, whereby the complimentary features and movable bar forms the one-way mechanism.

40. The anchor as claimed in claim 1 wherein the locking mechanism is a sleeve that locates at least in part about the longitudinal axis, the sleeve having external engaging portions on its outer peripheral surface, and internal engaging portions on its inner peripheral surface, the sleeve locating in a base portion such that the external engaging portions engage with complimentary portions in the base portion, and the internal engaging portions engage with its respective wing when in a first locking position, the sleeve adapted to slide along its respective pivot axis to a second locking position, such that one, either or both, the external engaging portions, and the internal engaging portions are free of the base portion or respective wing, such that in the second position the wing is then allowed to pivot about the pivot axis.

41. The anchor as claimed in claim 1 wherein the locking mechanism allows movement of the wings one way, but not the other.

42. The anchor as claimed in claim 1 wherein a center of a crossing of the pair of pivotally connected wings is on the longitudinal axis.

43. The anchor as claimed in claim 1 wherein each said wing consists of two lobes, each positioned at either side of the longitudinal axis.

44. The anchor as claimed in claim 43 wherein the wings and their lobes are of substantially the same size.

45. The anchor as claimed in claim 43 wherein the lobes of one wing of the pair of pivotally connected wings are smaller than the lobes of the other wing of the pair of pivotally connected wings.

46. The anchor as claimed in claim 43 wherein each said wing has said lobes of a first size and lobes of a second size which is of difference size to the first size.

47. The anchor as claimed in claim 1 wherein the anchor has additional contouring on it to help engagement and retention with the material.

48. A method of providing an anchor for a material, comprising or including, the steps of, pivotally connecting a pair of wings about at least one longitudinal axis and allowing the pair of wings to move pivotally relative to each other between a first position in an open state and a second position in a closed state, where the open state has a dimension between opposing parts of each wing pair that is greater than when in the closed state, locking the pair of wings in either the first position or the second position, providing a connecting portion connected to the pair of wings which is adapted to connect to a load, the connecting portion having a loading axis which is substantially parallel to the longitudinal axis, wherein the method allows for the anchor to be set between either the first position, or the second position, and then anchored into the material to enable the load to be connected to the anchor.

* * * * *